US007427966B2

(12) United States Patent
Boss et al.

(10) Patent No.: US 7,427,966 B2
(45) Date of Patent: Sep. 23, 2008

(54) DUAL POLARIZED ANTENNA

(75) Inventors: Michael Boss, Riedering (DE); Maximilian Gottl, Frasdorf (DE); Norbert Kreuzer, Pfaffenhofen (DE); Jörg Langenberg, Prien am Chiemsee (DE); Jürgen Rumold, Bad Endorf (DE)

(73) Assignee: Kathrein-Werke KG, Rosenheim (DE)

( * ) Notice: Subject to any disclaimer, the term of this patent is extended or adjusted under 35 U.S.C. 154(b) by 229 days.

(21) Appl. No.: 11/319,211

(22) Filed: Dec. 28, 2005

(65) Prior Publication Data

US 2007/0146225 A1 Jun. 28, 2007

(51) Int. Cl.
*H01Q 21/26* (2006.01)

(52) U.S. Cl. ..... 343/797; 343/797; 343/810

(58) Field of Classification Search ..... 343/797, 343/810

See application file for complete search history.

(56) References Cited

U.S. PATENT DOCUMENTS

| | | | |
|---|---|---|---|
| 3,541,559 | A | 11/1970 | Evans et al. |
| 5,469,181 | A | 11/1995 | Yarsunas |
| 5,710,569 | A | 1/1998 | Oh et al. |
| 6,195,063 | B1 | 2/2001 | Gabrield et al. |
| 2002/0101388 | A1 | 8/2002 | Ippolito |
| 2003/0011529 | A1* | 1/2003 | Gottl ..... 343/795 |
| 2003/0184491 | A1 | 10/2003 | Jocher |

FOREIGN PATENT DOCUMENTS

| | | | |
|---|---|---|---|
| CA | 2 261 625 | | 12/1998 |
| CA | 2 322 029 | | 7/2000 |
| DE | 198 60 121 | A1 | 7/2000 |
| DE | 101 04 564 | C1 | 9/2002 |
| DE | 102 36 071 | | 3/2005 |
| DE | 103 36 072 | A1 | 3/2005 |
| DE | 10336071 | B3 | 3/2005 |
| EP | 0 916 169 | | 5/1999 |
| EP | 0916169 | B1 | 5/1999 |
| EP | 0973231 | A2 | 1/2000 |
| WO | WO98/36472 | A | 8/1998 |
| WO | WO 02/05383 | A1 | 1/2002 |
| WO | WO 2005/015600 | | 2/2005 |
| WO | WO2005/105690 | A1 | 2/2005 |

OTHER PUBLICATIONS

International Search Report issued in corresponding PCT application. (Mar. 28, 2007).

* cited by examiner

*Primary Examiner*—Trinh V Dinh
(74) *Attorney, Agent, or Firm*—Nixon & Vanderhye P.C.

(57) ABSTRACT

A dual polarized antenna with at least one dual polarized radiator device comprises a reflector (3) and longitudinal or transverse webs (9, 11) provided at least on its longitudinal side and/or on its transverse side. The improvement is distinguished by the following features: at least one longitudinal web (9) and/or at least two longitudinal webs (9) provided with respect to the radiator device (1, 1') located in between and/or at least one transverse web (11) and/or at least two transverse webs (11) provided with respect to the radiator device (1, 1') located in between are positionally changeable directly or at least indirectly by pivoting and/or bending and/or deforming and curving.

21 Claims, 20 Drawing Sheets

DUAL POLARIZED ANTENNA

The invention relates to a dual polarized antenna according to the precharacterizing clause of claim 1.

Particularly the antennas provided for a base station of a mobile radio antenna usually comprise a reflector, for which a multiplicity of radiator devices are provided, lying offset in relation to one another in the vertical direction, for example dual polarized radiators and/or patch radiators. These can, for example, radiate and receive in one or two polarizations perpendicular to one another. The radiator elements may in this case be designed to receive only in one frequency band. The antenna arrangement may, however, also be formed as a multiband antenna, for example to transmit and/or receive in two frequency bands offset in relation to one another. Also known are so-called triband antennas and multirange antennas covering further frequency bands.

It is usually required of mobile radio antennas that are in use that the elevation of the boresight is either horizontal or slightly lowered (for example up to 10° or 15°). Furthermore, it is usually intended that the half-power beamwidth in a section in the elevation direction is less than the half-power beamwidths in a section in the azimuth direction. Therefore, a mobile radio antenna is usually installed and designed in such a way that the longest extent runs vertically. Customary half-power beamwidths may be, for example, around 45°, 65°, 90°, 120° etc.

In addition, mobile radio antennas of the current generation are constructed in such a way that their so-called downtilt angle can preferably be set in such a way that it can be changed under remote control. In other words, the angle of emission can generally be set downward in different orders of magnitude, the relevant mobile radio cell in which a transmission is taking place changing as a result.

Setting and adjusting phase shifting devices by means of a control unit that can be remotely controlled and retrofitted has become known for example from DE 101 04 564 C1.

In many cases, however, it is desirable to perform beam shaping. This applies on the one hand with respect to the changing of the half-power beamwidth (in particular in the horizontal or azimuth direction and more rarely in the vertical or elevation direction) and on the other hand also with respect to the changing of the boresight (usually by varied setting of the downtilt angle, but possibly also by changing the boresight in the azimuth direction).

An antenna arrangement with variable beam shaping, in particular also in the horizontal direction, is known for example from WO 2005/015600 A1. According to these already known antennas, radiators with variable power division are fed via phase shifters and a hybrid arrangement, which are arranged in at least two columns. The power division allows corresponding beam shaping with varied alignment in the horizontal direction. However, the beam shaping mentioned is only possible here when an antenna array with at least two columns is used.

An alternative possibility for beam shaping is also disclosed for example by DE 103 36 072 A1. This takes place by using at least two radiator devices, the principal axes of which are aligned at an angle in relation to one another. A network allows the at least two radiators to be fed with different intensities, whereby, in dependence on this, a different alignment of the boresight can be achieved by the angular arrangement of the two main lobes of the two radiator devices and by the power-dependent feeding.

Finally, a possible way of producing beam shaping is also disclosed in principle by WO 02/05383 A1. By use of an antenna array with at least three columns, in which at least one radiator device is respectively arranged, a certain beam shaping can be brought about by different feeding of the radiator device that is located in the middle in comparison with the radiator devices that are on the outside.

The object of the present invention is to provide a comparatively improved dual polarized antenna, in particular a mobile radio antenna, which, by means of simple technical measures, allows beam shaping in certain ranges, for example with respect to the boresight that can be variably set and/or a variable half-power beamwidth.

The object is achieved according to the invention in a way corresponding to the features specified in claim 1. Advantageous refinements of the invention are specified in the subclaims.

According to the present invention, it is possible to carry out beam shaping by simple means, to be precise already with respect to an individual beam or an individual group of radiators, i.e. in particular also with respect to an antenna with radiator elements which are for example arranged just in one column or row.

In this case, the beam shaping with respect to the boresight of the antenna (that is to say the alignment of the main lobe) can be carried out in the vertical and/or horizontal direction. The corresponding changing of the setting of the half-power beamwidth can likewise be brought about in the vertical and/or horizontal direction.

In this case, the invention can be realized in its basic form with respect to a single dual polarized radiator device, for example in the form of a dual polarized dipole radiator (for example in the form of a dipole cruciform, a dipole square or in the form of a so-called vector dipole, as is known in principle from DE 198 60 121 A1) or in the form of a dual polarized patch radiator and/or using both aforementioned types of radiator.

A particularly surprising aspect of the invention is that the desired advantages to achieve the object that is addressed can also be realized in the case of a dual polarized radiator or dual polarized antenna of which the radiators, radiator elements or groups of radiators can radiate and/or receive in two polarizations perpendicular to one another, which are aligned at an angle of +45° or −45° with respect to the vertical (and therefore similarly with respect to the horizontal).

However, the corresponding beam shapings are similarly possible if, for example, the antenna is extended at least to a single-column antenna, in which for example a number of radiator devices arranged one above the other in the vertical direction are provided. Similarly, however, the antenna may also be extended in such a way that, for example, a number of radiator devices arranged next to one another only in the horizontal direction are provided. Finally, however, an antenna array may also be constructed according to the invention, to be precise with a number of, generally vertically running, columns arranged next to one another (that is to say lying offset in relation to one another in the horizontal direction), in which a number of radiator devices, that is to say at least two, are respectively provided, for example in the form of dual-polarized dipole radiators and/or in the form of dual-polarized patch radiators.

In the case of the antenna according to the invention, its basic unit is assumed to comprise a configuration in which at least one radiator or one group of radiators is provided, to be precise in front of a reflector. The reflector has in this case a longitudinal direction and a transverse direction (generally perpendicular to the longitudinal direction). Usually, antennas of this type are set up in such a way that the longitudinal direction runs parallel to the vertical direction or is substantially vertically aligned, so that the transverse direction points more or less in a horizontal direction.

As known per se, in this case longitudinal webs rise up from the reflector (longitudinal webs lying offset respectively to the left and right of the radiator device located in between), which with corresponding vertical alignment then run vertically or substantially vertically. Alternatively and in addition, transverse webs projecting from the reflector may also be provided (between which again the at least one radiator is then likewise arranged), which with customary alignment of the antenna can then run in the horizontal direction or substantially in the horizontal direction. These longitudinal and transverse webs may be provided on the outer edges of the reflector, but they may also be positioned elsewhere on the reflector, that is to say offset away from the outer edges, closer to the associated radiator.

The radiator itself is—as already mentioned—preferably aligned in such a way that the two polarization planes that are perpendicular to one another are arranged running at an angle of ±45° with respect to the longitudinal or transverse webs. Generally, it is intended that the radiators are arranged in such a way that they are preferably arranged running an angle of ±45° or substantially of ±45° with respect to the longitudinal and/or transverse struts.

According to the invention, it is then provided that at least one longitudinal or transverse web, preferably at least the two respectively interacting longitudinal webs and/or transverse webs, can be changed in their alignment position in such a way that a relevant longitudinal and/or transverse web runs away from the reflector in such a way that in one position it runs rather toward the associated radiator or, in another alignment position, it runs rather away from the radiator, or, in an intermediate position preferred as desired, it can be aligned between these extreme positions.

In a preferred embodiment, the two longitudinal and/or transverse webs respectively can be activated individually and/or independently or in pairs (possibly also synchronously), in particular also adjusted under remote control or manually, in such a way that the two run for example aligned more to the left with respect to a longitudinally running axis of symmetry or relatively more to the right. In particular when remote control is used, it may also be formed in a way allowing it to be retrofitted.

Finally, in a preferred embodiment it is also possible for example to align the longitudinal and/or transverse webs so differently that the clear distance between them is increased or reduced, that is to say the longitudinal or transverse webs are aligned with respect to the radiator situated between them in such a way that they are rather divergent or rather convergent in the direction of radiation.

The rather parallel pivoting to the left and right allows the direction of the main lobe to be adjusted, whereas opposed pivoting of the longitudinal or transverse webs with rather divergent alignment allows the half-power beamwidth to be reduced and with rather convergent alignment allows the half-power beamwidth to be increased. This is possible not only in the case of a single radiator but also for example in the case of an antenna with beams which are arranged just in one column or just in one row.

The corresponding positional change may take place for example by pivoting the longitudinal and/or transverse webs, for example by means of pivoting axes which are preferably formed at the transition from the reflector plane to the longitudinal webs. These pivoting axes may also be formed as bending axes. These pivoting or bending axes may, however, also be formed part-way up the side limitation or in a portion of the reflector, so that a partial area of the reflector can be pivoted with the lateral or transverse limitations.

Finally, it is also quite possible, for example, for deformation forces, preferably elastic deformation forces, to act on the reflector and/or the longitudinal side limitation or transverse side limitation, by means of an adjusting device, and for these forces to bend such limitations, preferably elastically, according to requirements in each case in such a way that with one component they optionally run toward the associated radiator or away from it to varied degrees.

In principle, it is also known from U.S. Pat. No. 5,710,569 A to use an antenna arrangement with displaceable side webs. However, this prior publication merely discloses a vertically polarized antenna using simple dipole radiators. In other words, it does not constitute a dual polarized antenna arrangement that operates with two polarizations perpendicular to one another.

Moreover, the polarization plane of the single polarized radiators according to U.S. Pat. No. 5,710,569 A is aligned parallel to the side webs, whereas in the case of the dual polarized antenna according to the present invention the polarization planes have at least substantially an angle of 45° in relation to the side limitations, i.e. in relation to the longitudinal webs.

As a difference from U.S. Pat. No. 5,710,569 A, it is envisaged within the scope of the solution according to the invention to carry out an optimization of the network with respect to the polarization decoupling (co-/cross-polarization ratio) during operation by the varied alignment of the longitudinal and/or transverse limitations with respect to an associated dual polarized radiator. Within the varied alignment of the longitudinal and/or transverse limitation, however, a change of the front-to-back ratio may also be brought about and the interference influenced. Finally, the solution according to the invention also has an effect on the gain of the antenna and the half-power beamwidth. In particular, the half-power beamwidth can be changed with correspondingly vertical alignment of the antenna in the horizontal and/or vertical direction and also the radiation of the main lobe can be changed or adjusted in the elevation direction (that is to say the downtilt angle) and in the azimuth direction. The dual polarized antenna according to the invention is also distinguished in particular by the retention of the polarization decoupling. It makes operation possible with a high bandwidth, for example of from 1710 to 2170 MHz or 806 to 960 MHz. The antenna is also broad-band in other frequency bands. In particular, a high isolation between the connections of the different polarizations, of for example 25 dB, 30 dB etc., can also be realized. A further, major advantage is the high intermodulation resistance for systems with a number of carriers or broadband systems.

In a particularly preferred embodiment, the corresponding antenna arrangement is constructed in such a way that at least one column is provided with a number of radiators arranged next to one another or one above the other in the longitudinal direction. If the reflector has, for example, only longitudinal limitations, these may also be arranged with varied side spacing in the case of the individual radiators or types of radiator. In a corresponding way, the reflector may also be designed such that it runs in the transverse direction with varied widths. The same applies when only transverse limitations are correspondingly used, if the number of radiators are arranged next to one another in the transverse direction.

If a number of radiators are arranged next to one another in the longitudinal and/or transverse direction, pairs of longitudinal and/or transverse limitations lying respectively next to one another are preferably used, in order that is to bring about the desired beam shaping for each associated radiator or each radiator array, irrespective of the neighboring radiator or radiator array.

The longitudinal and/or transverse webs are preferably electrically/galvanically connected directly to the actual reflector. If an electrically nonconductive pivoting or articulating arrangement is used, a connection between the longitudinal or side webs and the actual reflector area can be established by a separate, electrical/galvanic connection. However, a capacitive connection to the actual reflector is also possible with respect to the longitudinal and/or transverse webs. Moreover, the side wall parts mentioned (that is to say the longitudinal and/or transverse webs) may be electrically connected to one another, electrically/galvanically isolated or partly electrically connected. Similarly, the corresponding longitudinal or transverse webs may be formed separately for a radiator or a radiator arrangement and only partly mechanically connected according to requirements. The dimensions of the longitudinal or transverse webs may differ with respect to length and height, also with respect to their distance from the center point of an associated radiator. The longitudinal and transverse webs do not necessarily have to be formed as running straight in cross section, but may also be profiled as desired within wide ranges, for example be designed in a S-, L- or Z-shaped manner. Furthermore, the webs, in particular the side webs or the movable parts, may also be provided with so-called passive slots, as are known in principle from EP 0 916 169 B1. However, corresponding slots may also be formed by certain clearances being provided in the webs, for example clearances in the region of the axis or the bending region, in particular whenever the axis or the bending region is at a certain distance from the reflector. The electrical connection between stationary and moving parts then also has the corresponding slots or gaps.

The pivotable parts, in particular the longitudinal or transverse webs, may be at least partly capacitively coupled to the reflector (for example over a small distance) or electrically/galvanically connected to it. A capacitive coupling may also be possible by, for example, the reflector being provided with an electrically/galvanically connected, rotatable inner conductor part, forming its axis of rotation, which engages in a corresponding outer conductor part on the reflector, separated by a dielectric. The length of the inner conductor part is in this case preferably about $\lambda/4$, that is to say one quarter of the wavelength of a frequency band to be transmitted (usually preferably corresponding to the mid-frequency of a frequency band). However, other capacitive applications are also conceivable.

As already mentioned, the pivotable parts may be mechanically connected to the reflector, for example by means of a movable or conducting structure, for example in the form of spring elements, thin conductive layers on a film substrate or by using flexible regions, for example a partly flexible printed circuit board. A capacitive or line coupling with the reflector may take place for example by means of two areas or line elements, the coupling device then likewise again preferably having a length which corresponds approximately to $\lambda/4$ of the relevant operating wavelength (preferably the mid operating wavelength).

Finally, the longitudinal and/or transverse webs may also be formed entirely or partly from suitable dielectric material; here, too, corresponding beam shaping is possible within wide ranges.

The invention is explained in more detail below on the basis of exemplary embodiments, in which specifically:

Figure 1:
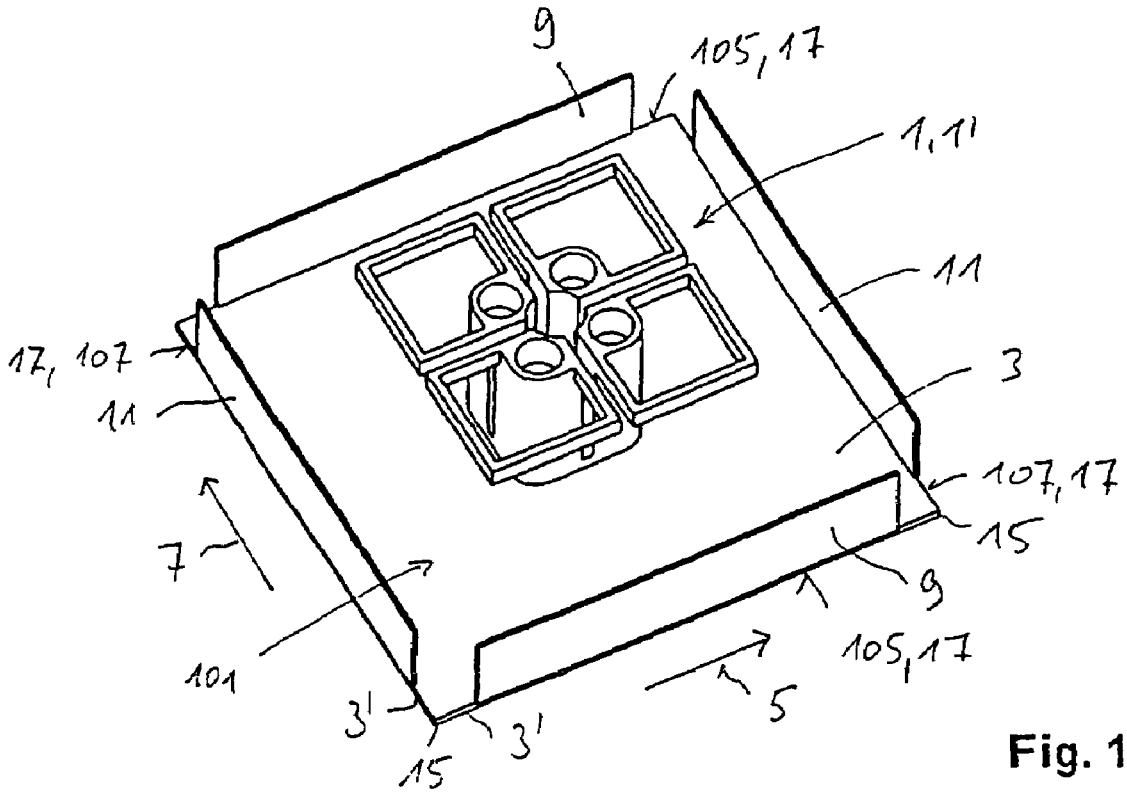
FIG. 1 shows a schematic perspective representation of a first exemplary embodiment of an antenna with a radiator device and longitudinal and/or transverse webs according to the invention.
Figure 2:
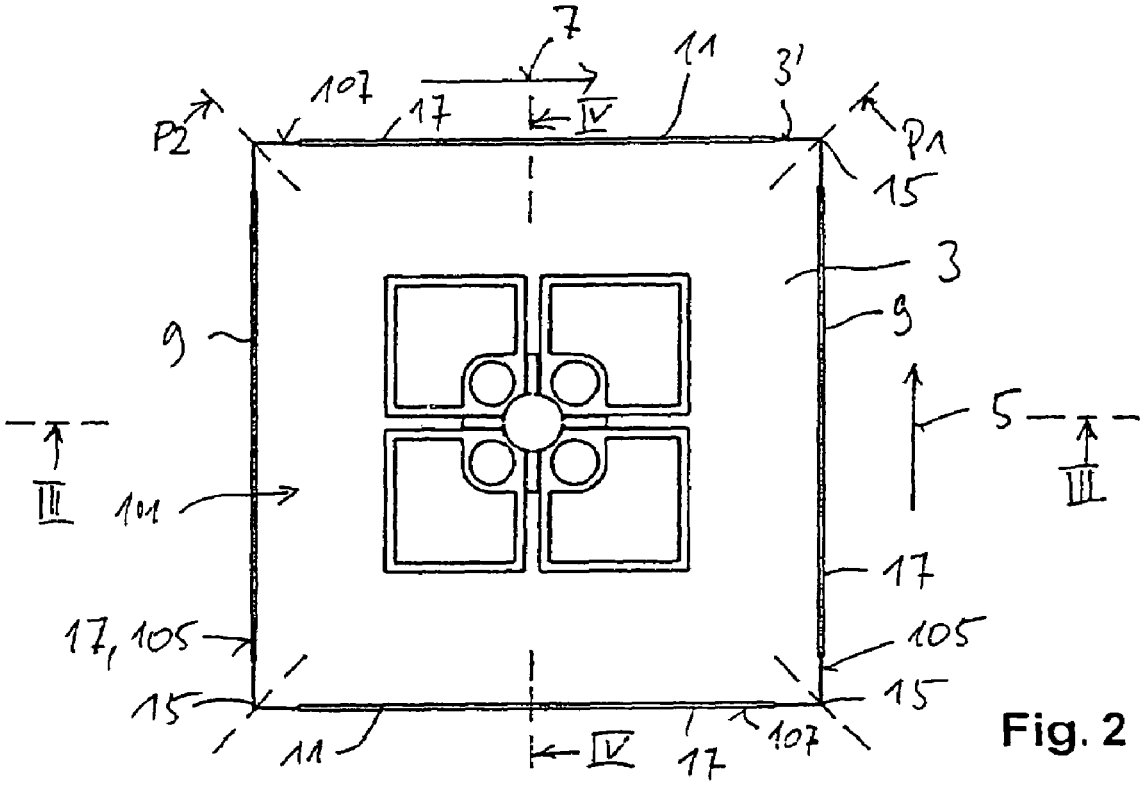
FIG. 2 shows a schematic plan view of the exemplary embodiment shown in FIG. 1.
Figure 3A:
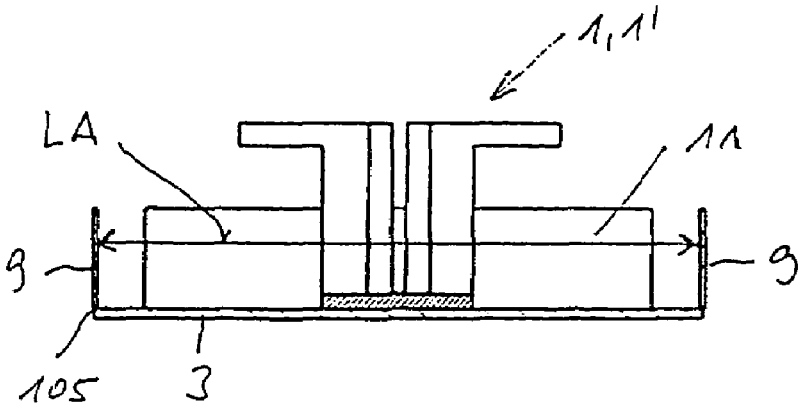
Figure 3B:
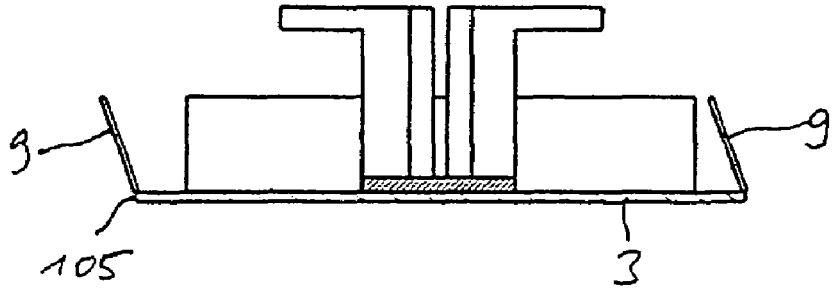
Figure 3C:
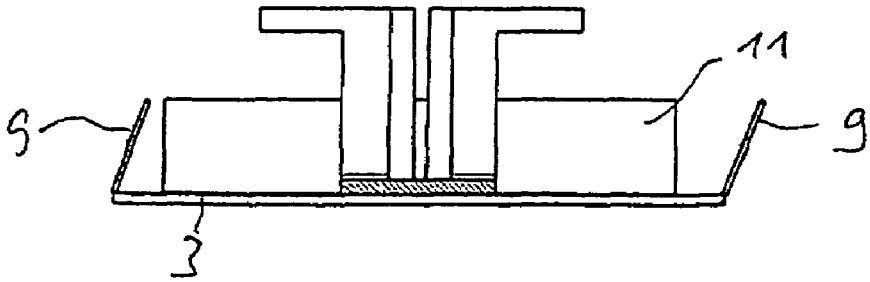
Figure 3D:
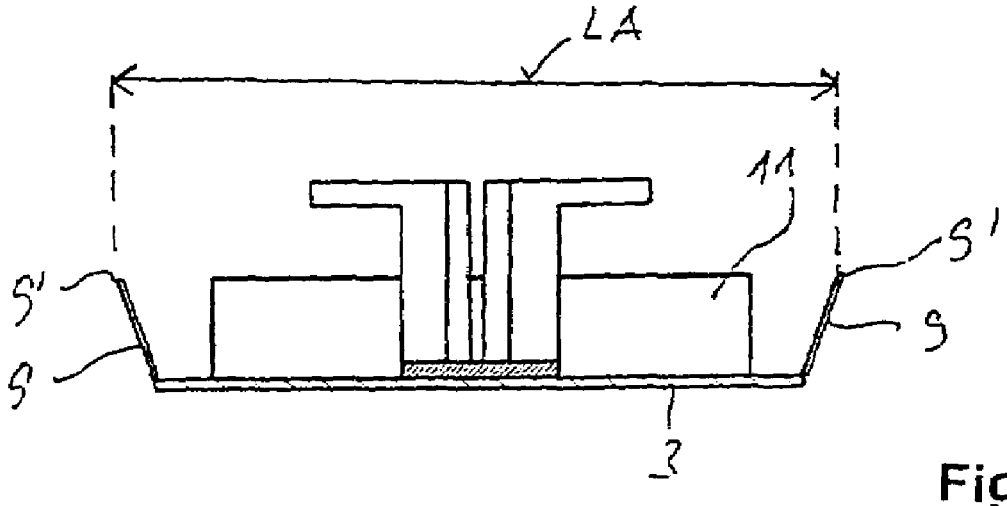
Figure 5:
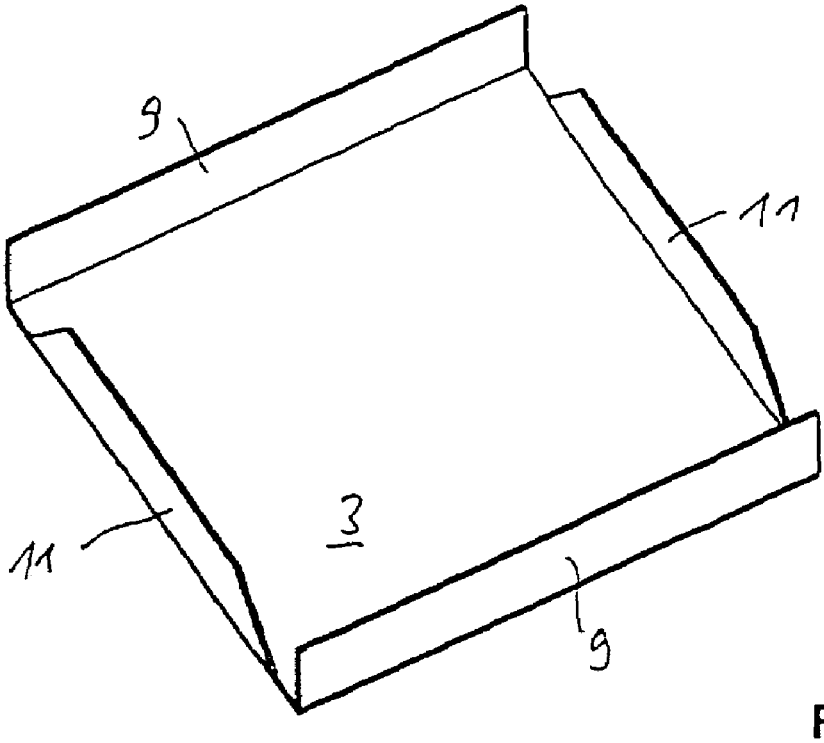
Figure 6:
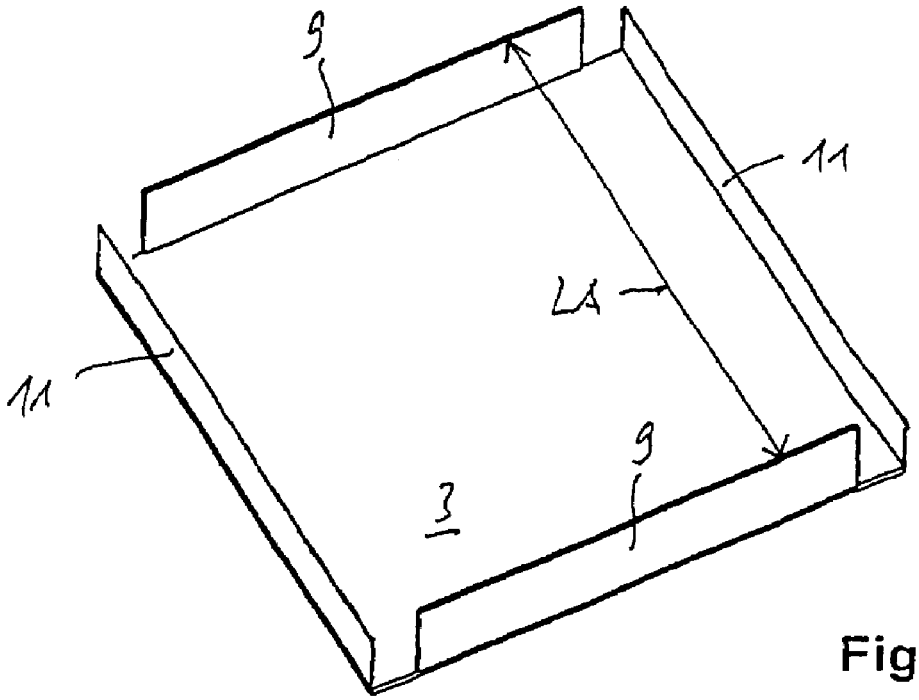
Figure 7:
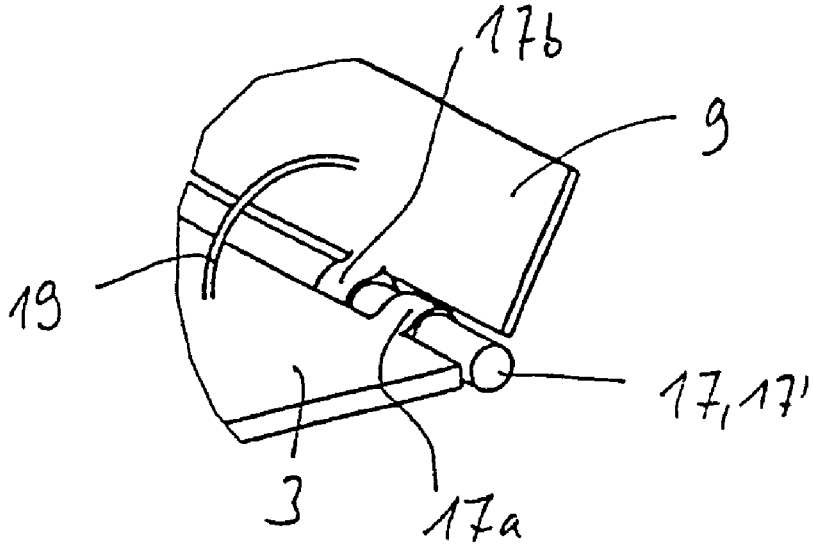
Figure 7A:
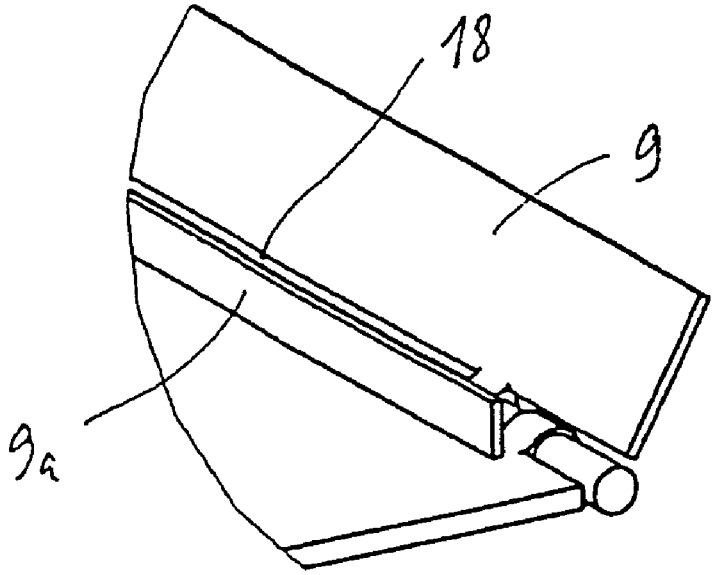
Figure 8:
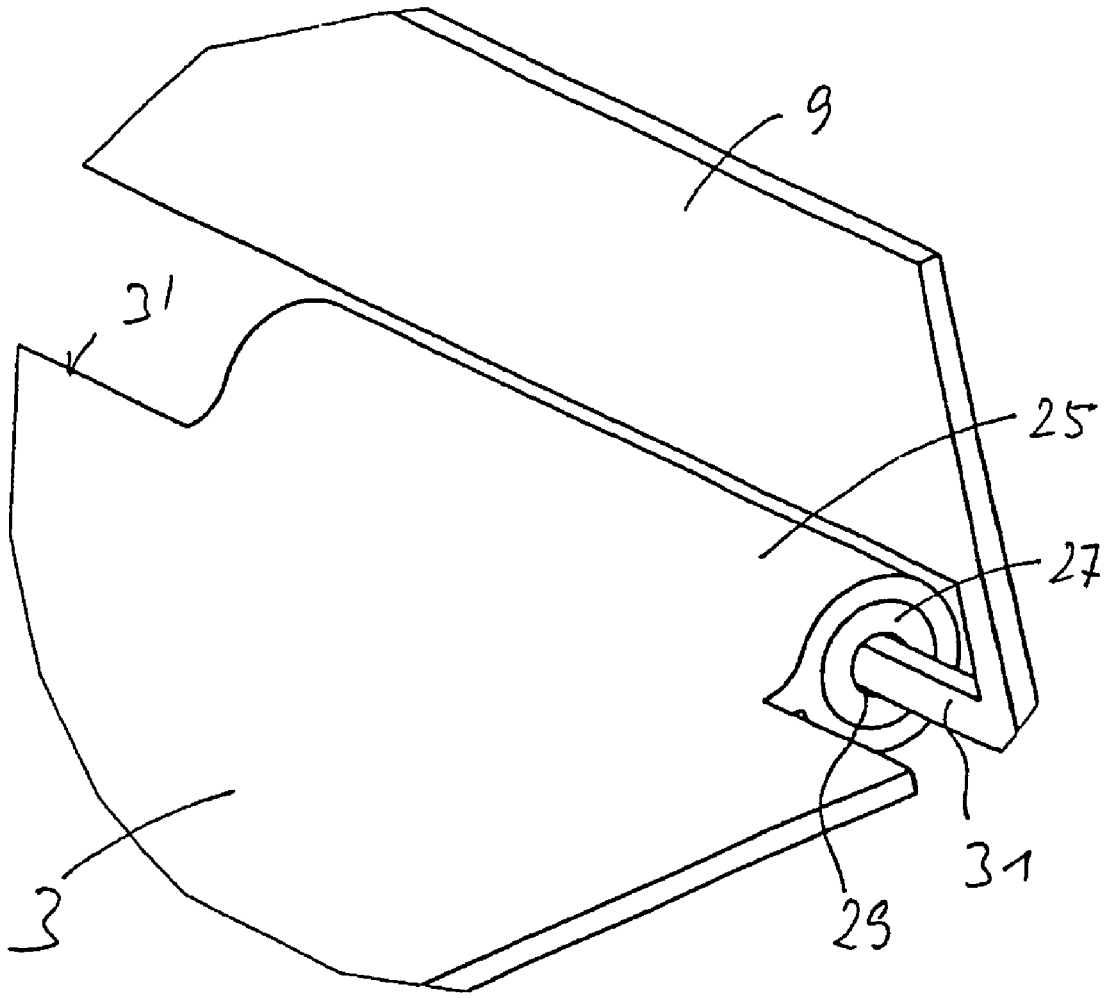
Figure 9:
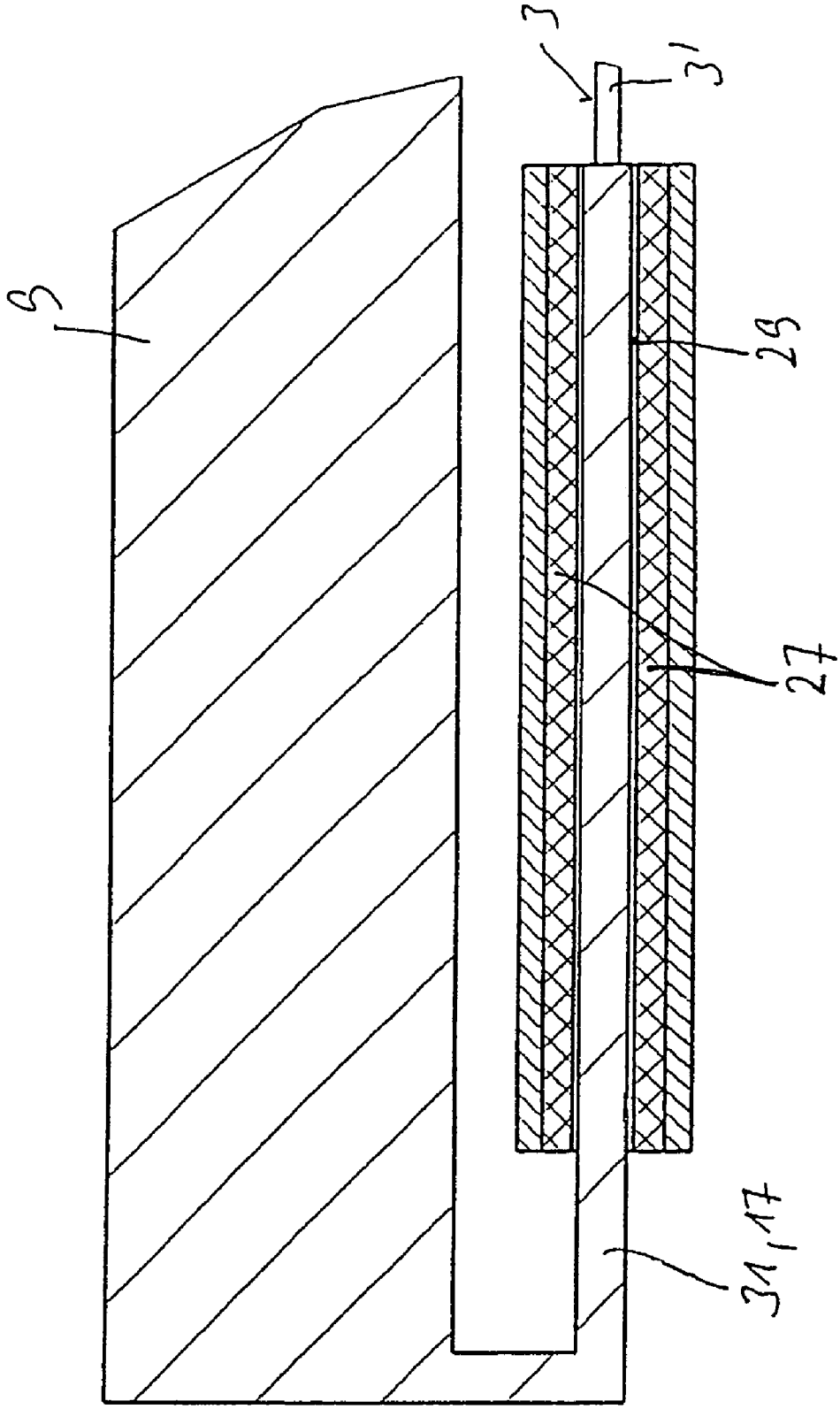
Figure 10:
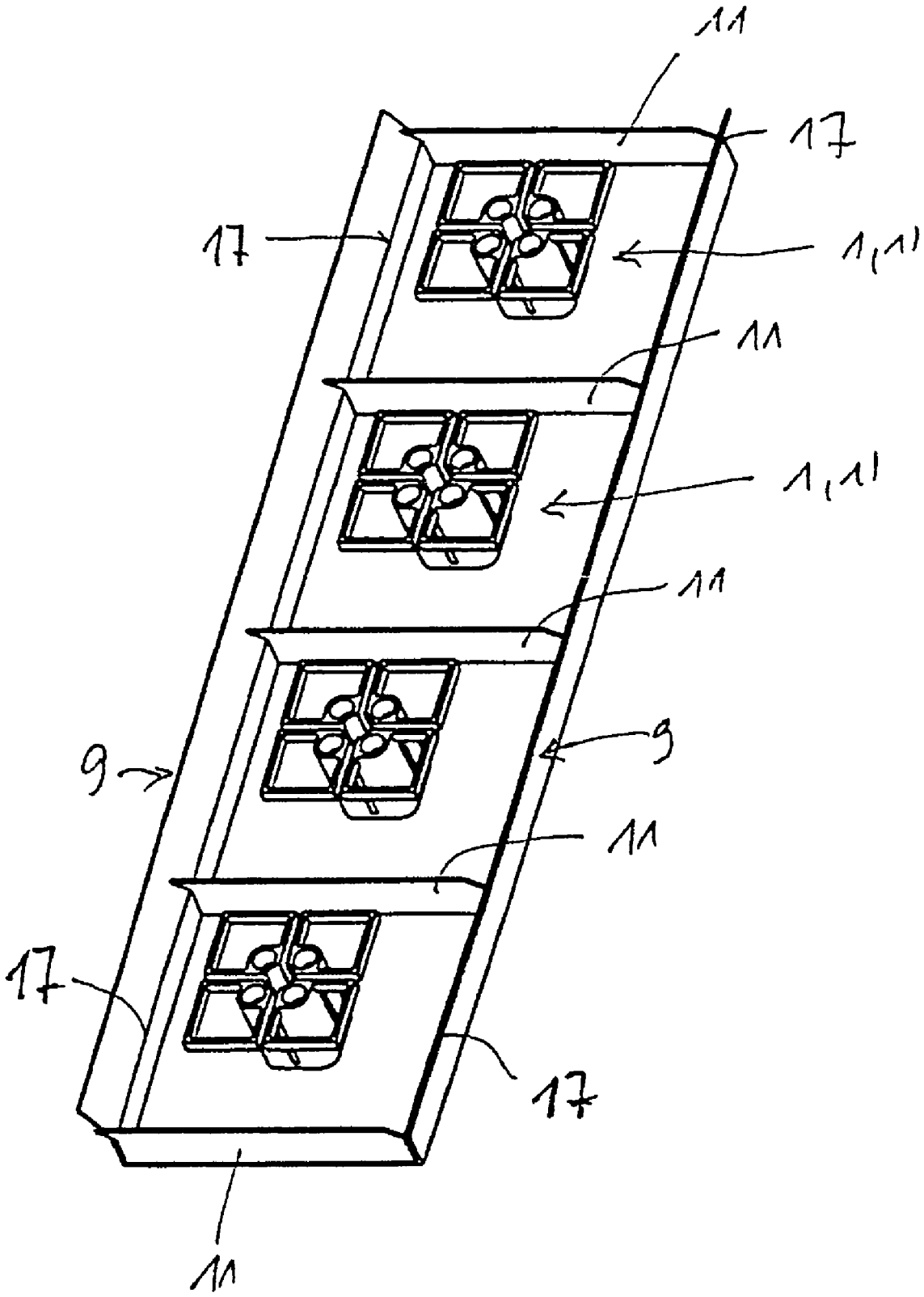
Figure 11:
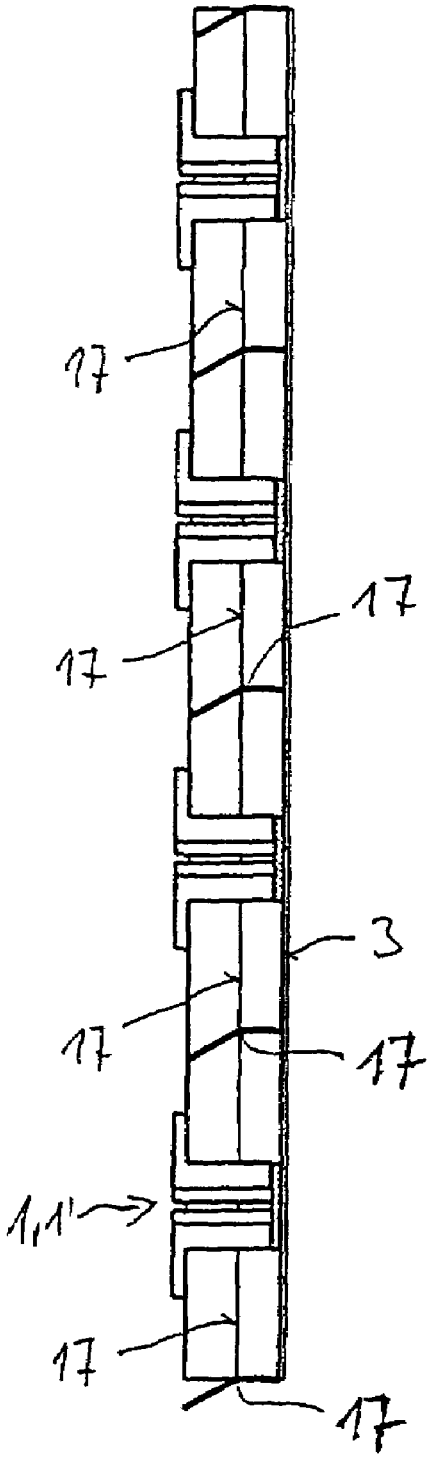
Figure 17:
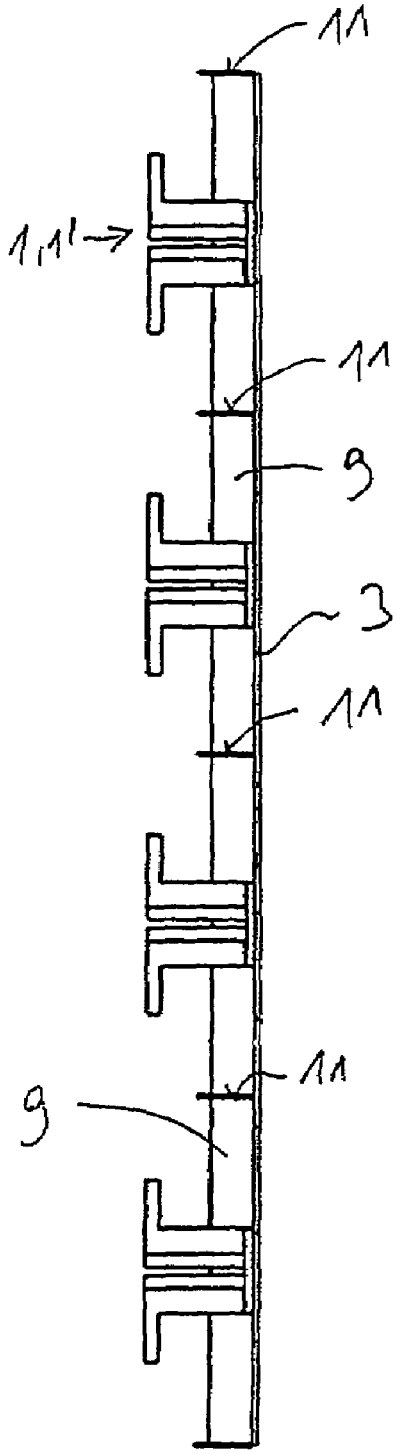
Figure 14:
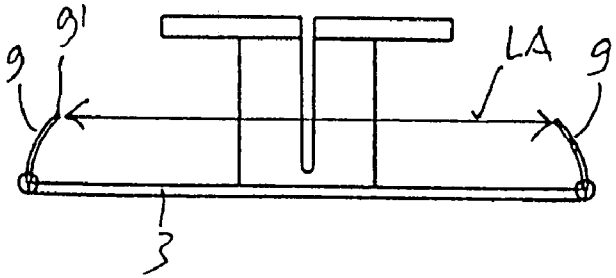
Figure 15:
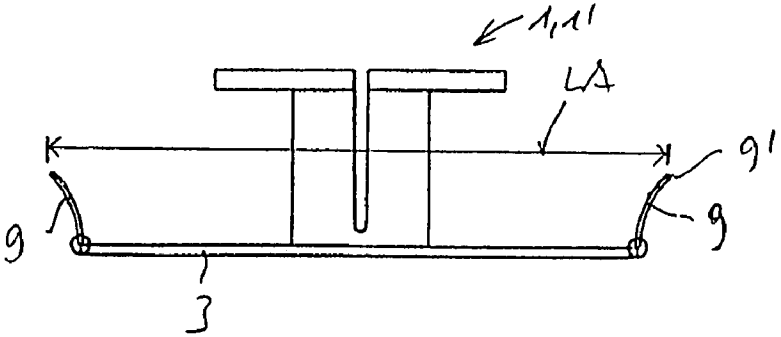
Figure 12:
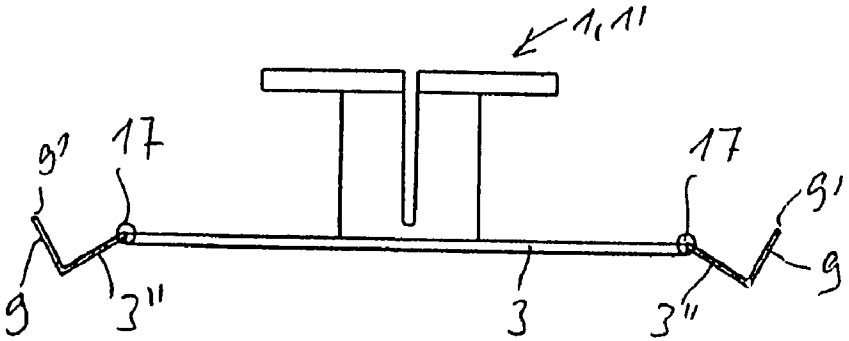
Figure 13:
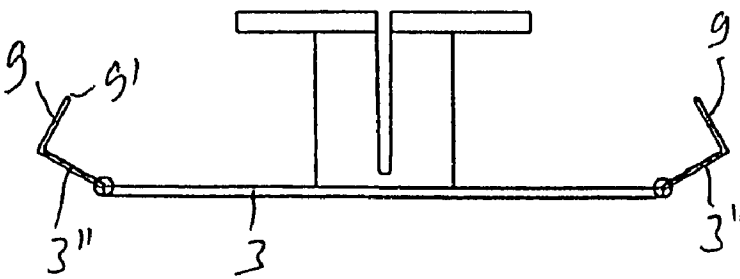
Figure 16:
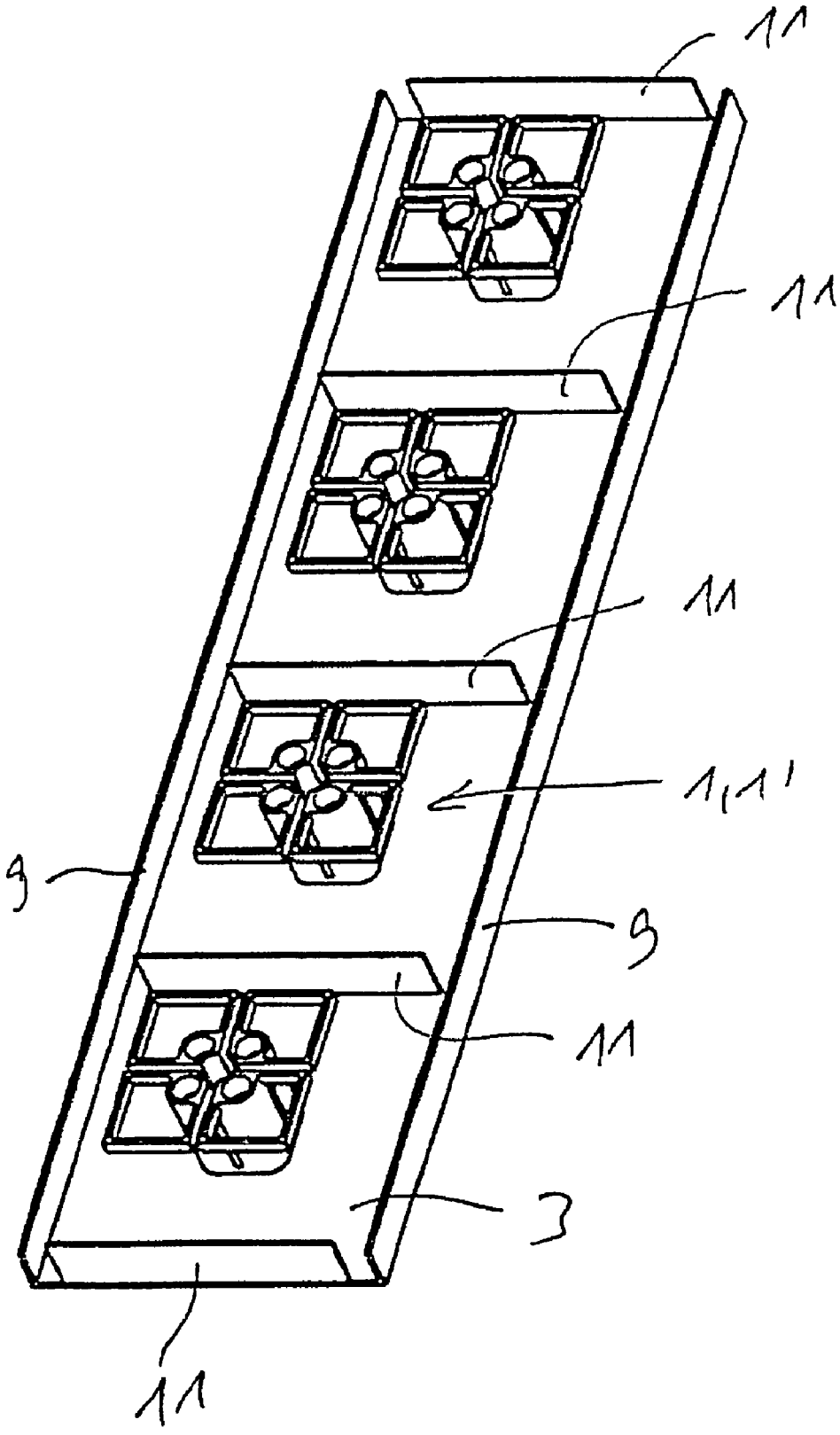
Figure 17A:
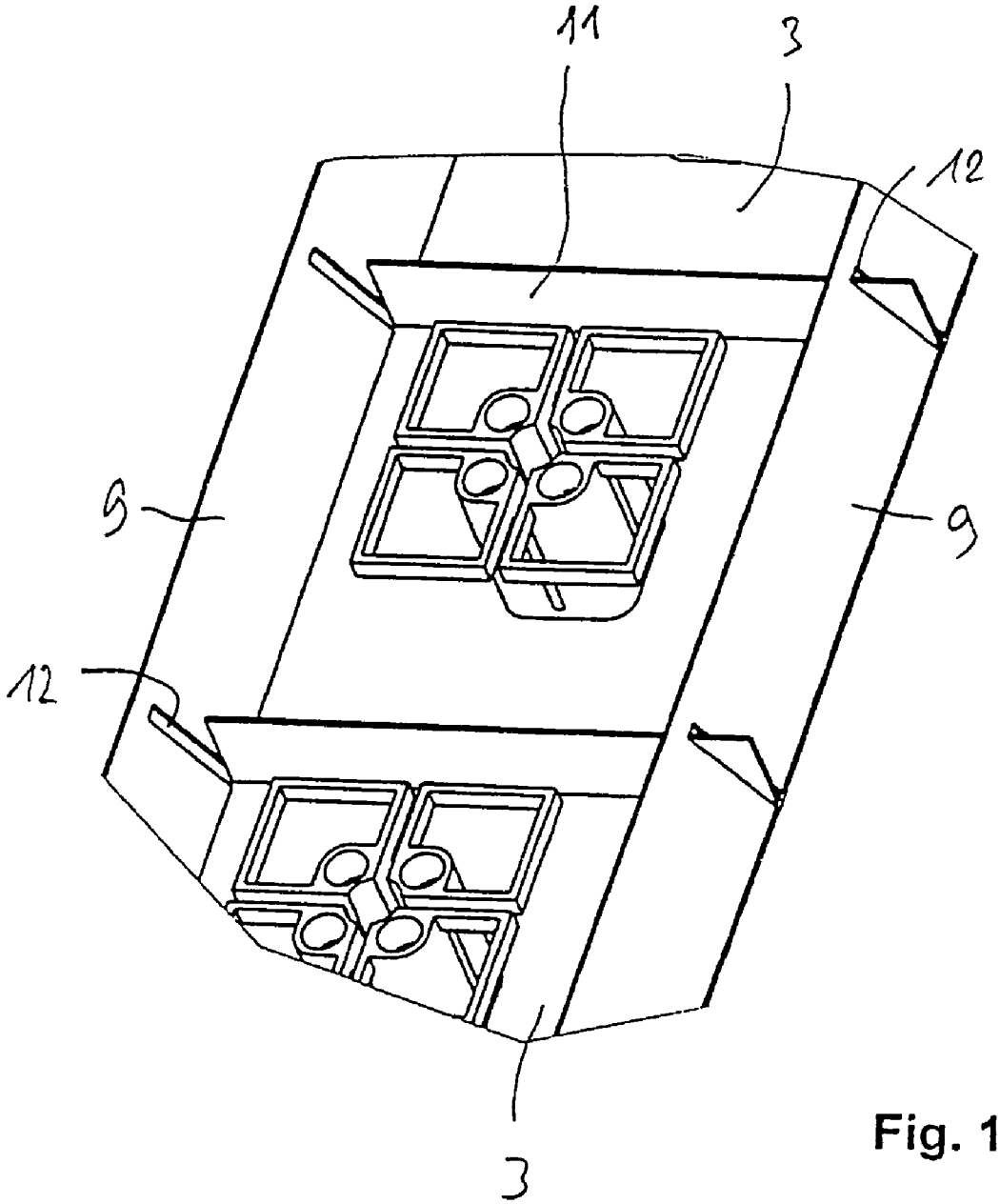
Figure 18:
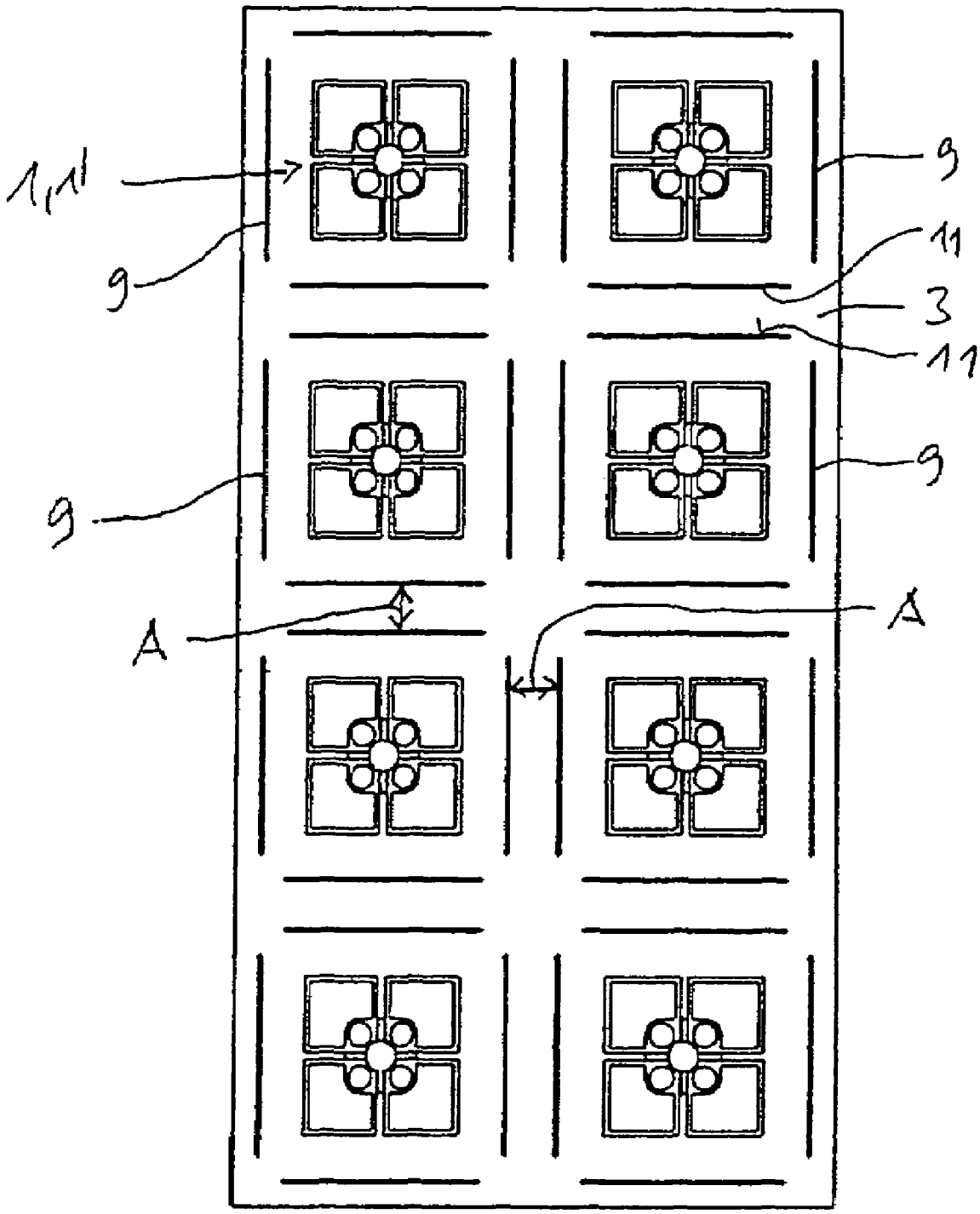
Figure 18A:
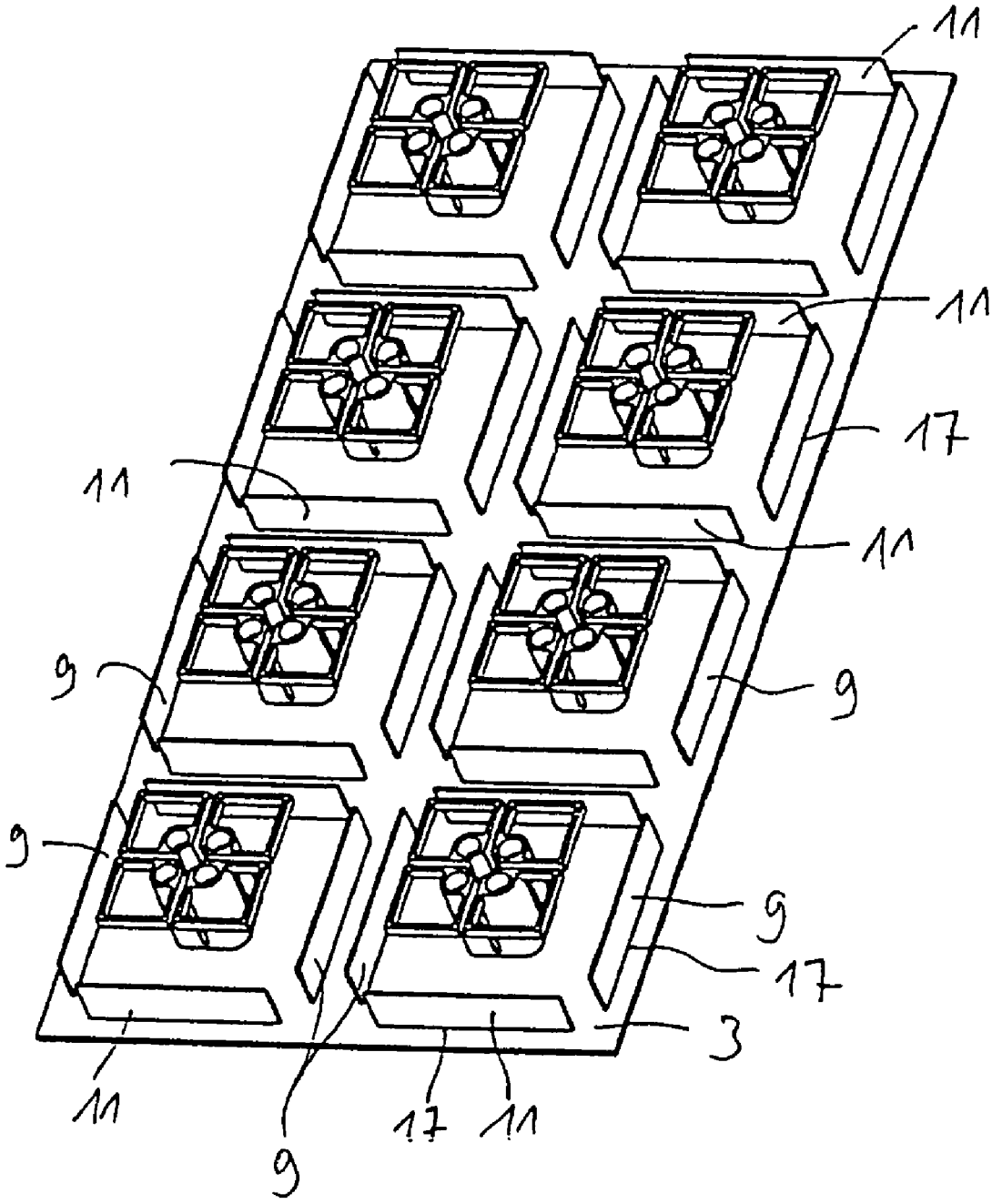
Figure 19:
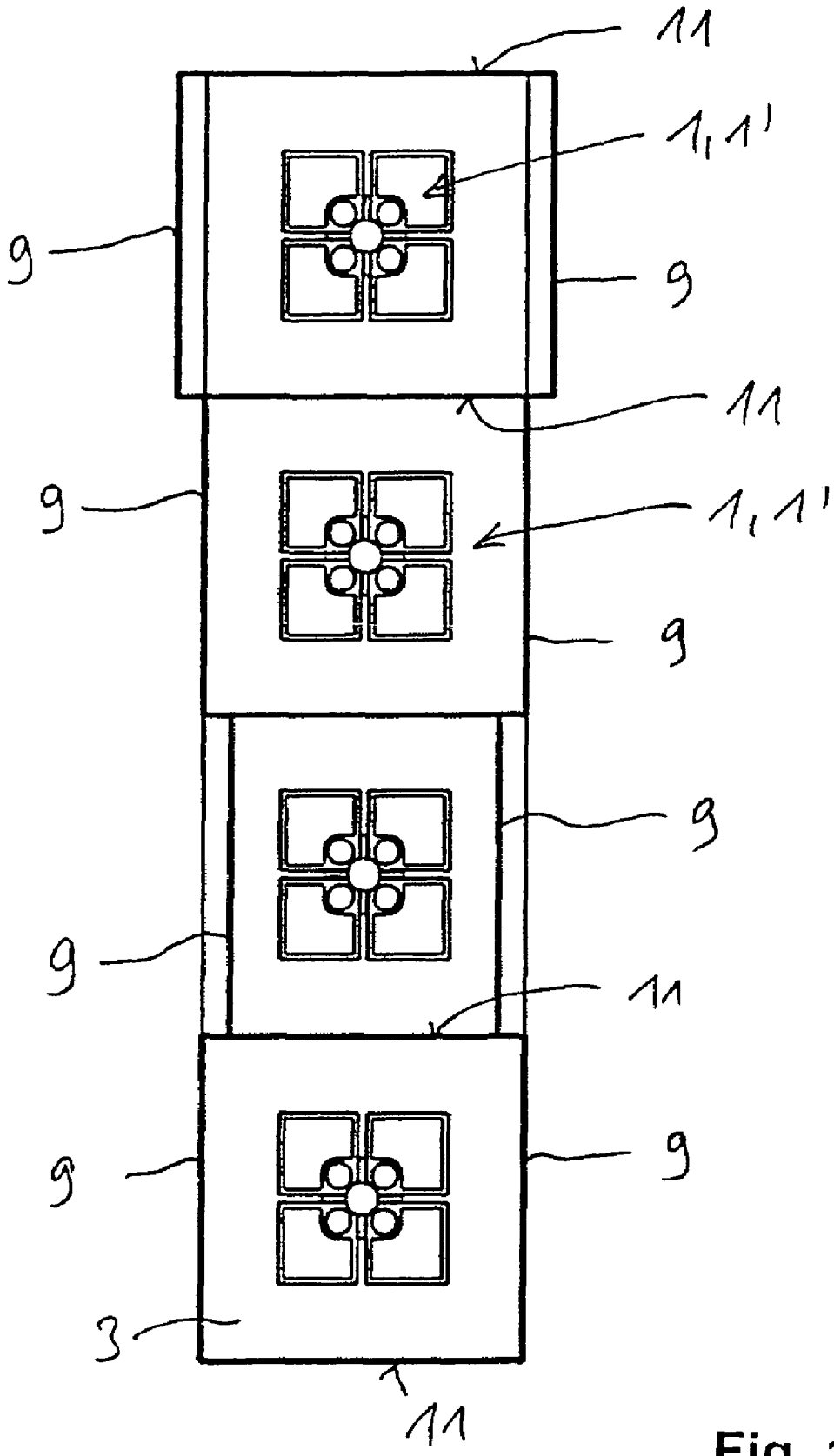
Figure 20:
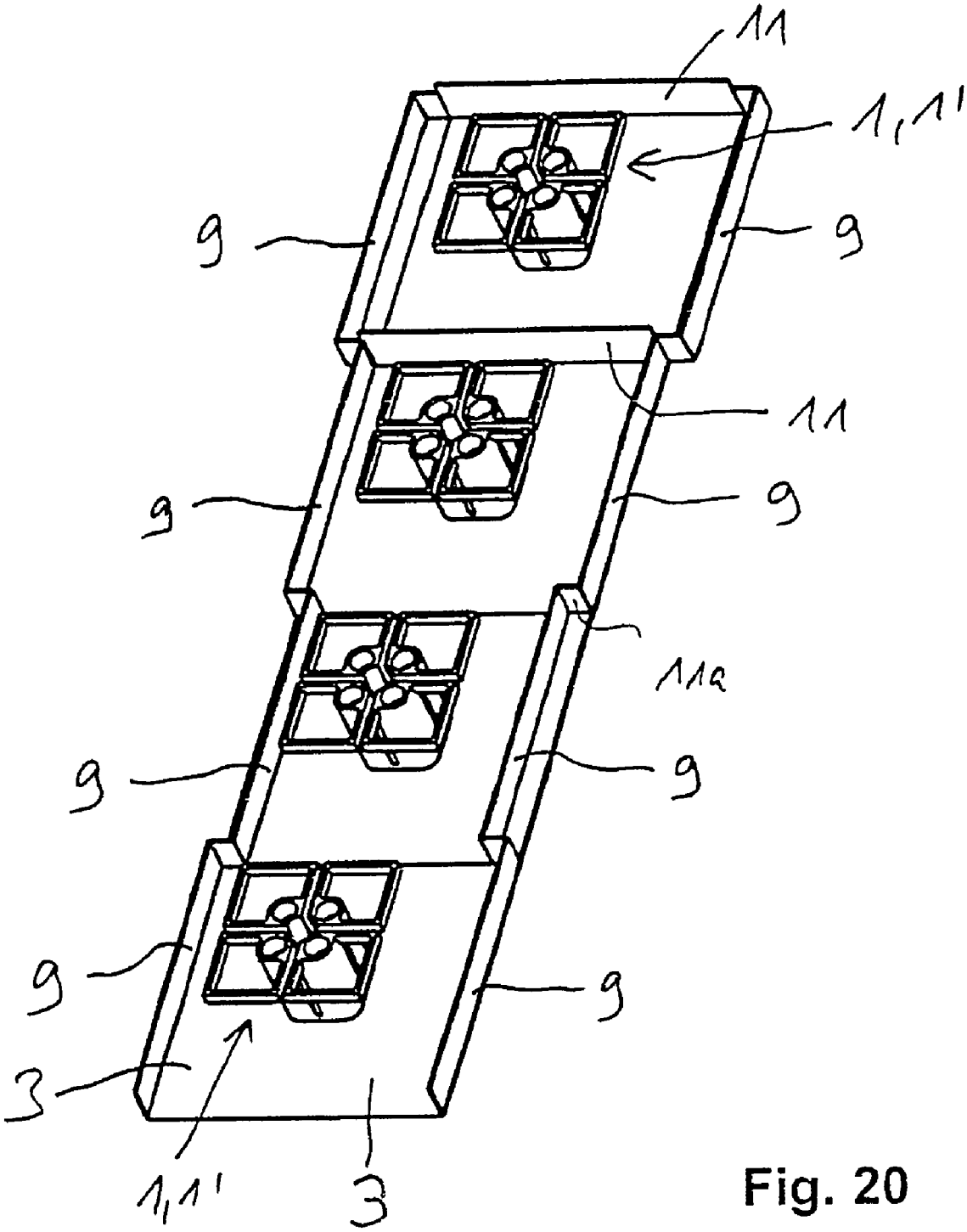
Figure 21:
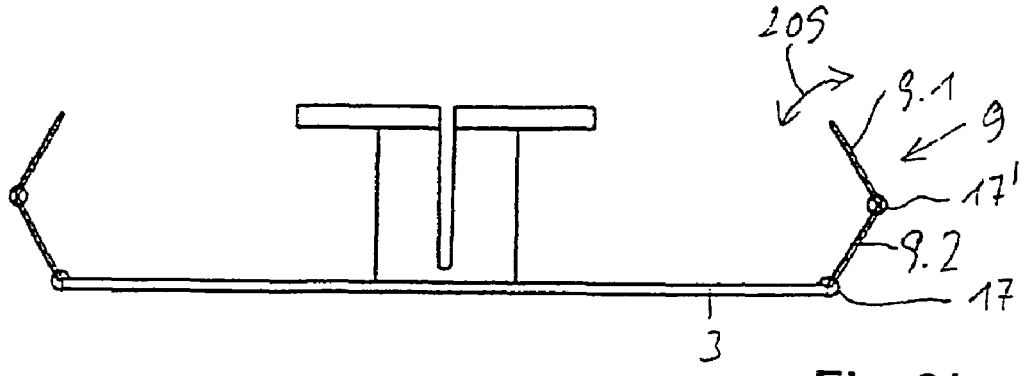
Figure 22:
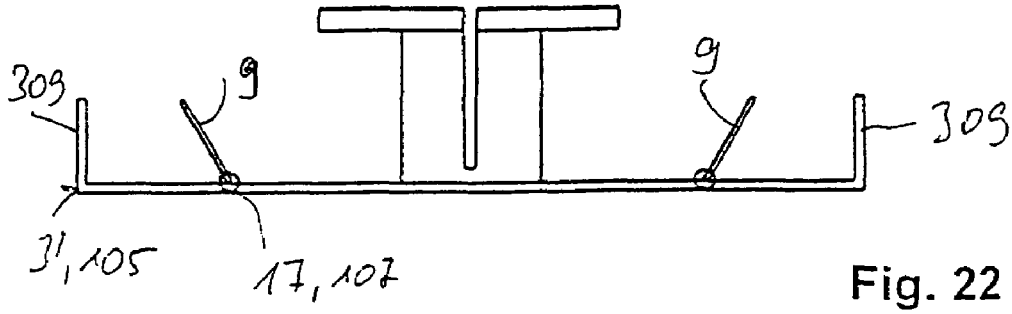
Figure 22A:
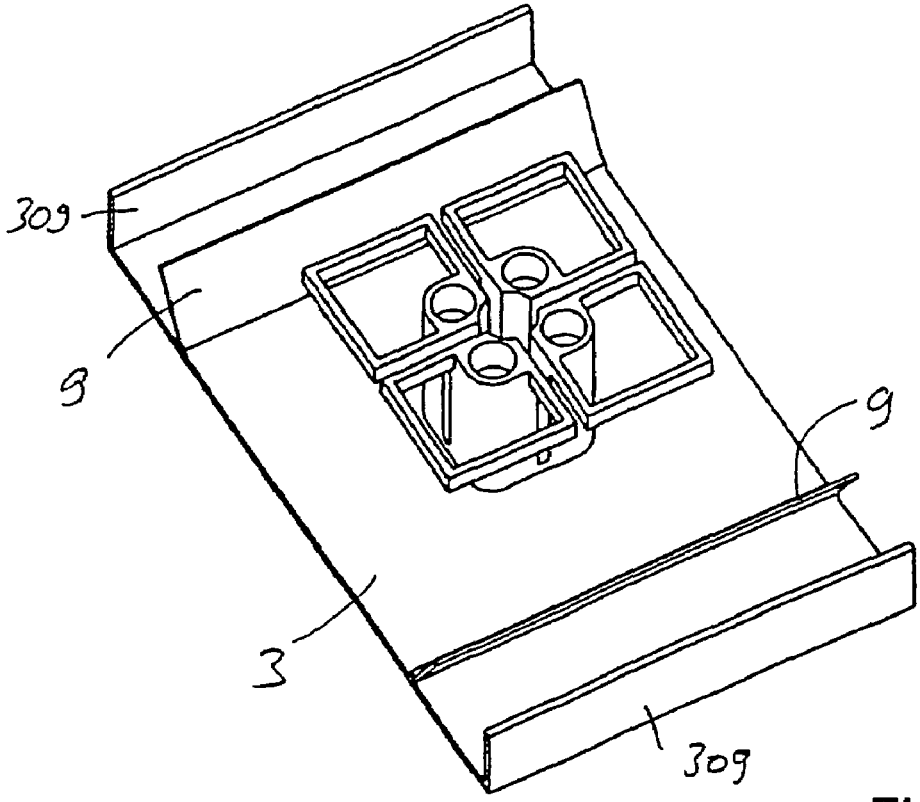
Figure 23:
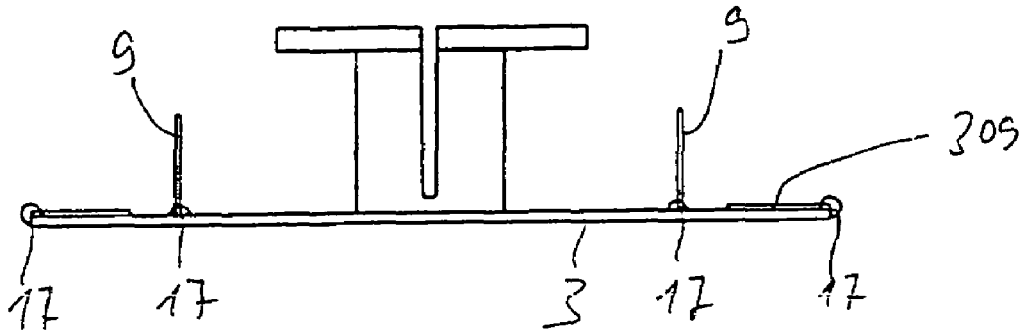
Figure 24:
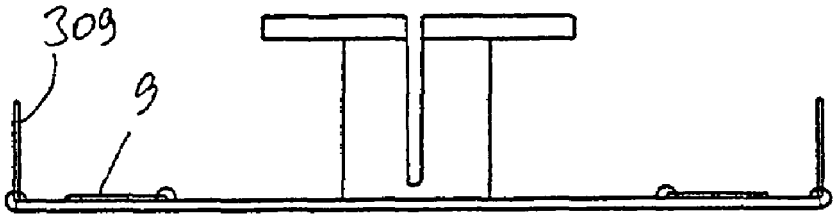
Figure 25:
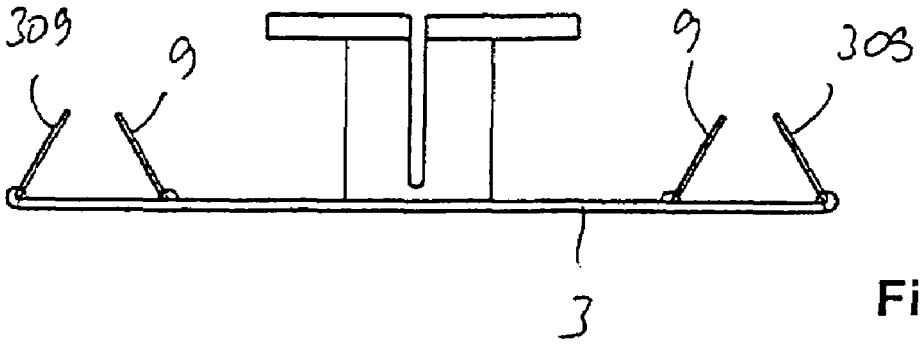

FIGS. 3*a* to 3*e* show cross-sectional representations along the line III-III in FIG. 2 and a reproduction of different pivoting possibilities of the longitudinal webs;

FIGS. 4*a* to 4*e* show cross-sectional representations along the line III-III in FIG. 2 and a reproduction of different pivoting possibilities of the transverse webs;

FIG. 5 shows a schematic plan view of the antenna according to the invention corresponding to FIG. 1, without the radiator arrangement with specifically designed longitudinal and/or transverse webs;

FIG. 6 shows an embodiment differing from FIG. 5;

FIG. 7 shows a schematic representation in extract form of a specific pivoting possibility of a longitudinal web with respect to a reflector;

FIG. 7*a* shows a slightly modified embodiment with respect to the representation according to FIG. 7;

FIG. 8 shows a modified exemplary embodiment according to FIG. 7;

FIG. 9 shows a longitudinal sectional representation through the coaxial, capacitive coupling according to FIG. 8;

FIG. 10 shows a perspective representation of a single-column antenna with four radiator devices with a modified embodiment with respect to the pivotable longitudinal and/or transverse webs;

FIG. 11 shows a schematic longitudinal sectional view of the exemplary embodiment according to FIG. 10;

FIGS. 12 and 13 show a schematic side representation comparable to FIGS. 3*b* and 3*d*, but with a differently arranged, formed pivoting device;

FIGS. 14 and 15 show two side representations with respect to an again modified exemplary embodiment with longitudinal and/or transverse webs that can be made to bend in themselves;

FIG. 16 shows a further exemplary embodiment according to the invention in a schematic perspective representation;

FIG. 17 shows a schematic longitudinal sectional view of the exemplary embodiment according to FIG. 16;

FIG. 17*a* shows an enlarged schematic representation with respect to a modification of FIG. 17, in which slots are provided in the longitudinal webs 9, in order that, when they are pivoted inward, the longitudinal webs do not collide with the transverse webs;

FIG. 18 shows a schematic front view of an antenna array according to the invention with two columns and a total of eight radiator devices;

FIG. 18*a* shows a representation corresponding to FIG. 18, but in a schematic spatial representation;

FIG. 19 shows a schematic front view of a further exemplary embodiment of an antenna array with four radiator devices, the side limitations 9 being arranged at different lateral spacings from one another for the individual radiator devices;

FIG. 20 shows a spatial plan view of the exemplary embodiment shown in FIG. 19;

FIG. 21 shows a cross-sectional representation of a further modification, in which for example the longitudinal webs have further pivoting axes;

FIG. 22 shows a further exemplary embodiment with four longitudinal webs, respectively running with lateral offset in parallel longitudinal extent, the inner longitudinal webs respectively being pivotable and the outer longitudinal webs respectively being fixed;

FIG. 22*a* shows a schematic spatial representation of the exemplary embodiment shown in FIG. 22;

FIG. 23 shows a further exemplary embodiment in a schematic cross-sectional representation comparable to that shown in FIG. 22, in which the two longitudinal webs running respectively in parallel longitudinal directions on one side of the radiator are pivotable individually and independently of one another, the outer longitudinal web according to FIG. 23 being flipped over inward;

FIG. 24 shows a representation corresponding to FIG. 23, in which the inner longitudinal webs on the reflector are flipped over and the outer longitudinal webs protrude away from the reflector; and FIG. 25 shows a further representation comparable to that shown in FIGS. 23 and 24, in which the longitudinal webs respectively neighboring in pairs, running in the longitudinal direction, run toward one another, for example when viewed from the reflector.

A first exemplary embodiment of the invention is explained below with reference to FIG. 1 and FIG. 2, FIG. 1 showing a schematic perspective representation of a first exemplary embodiment according to the invention of a dual polarized antenna and a front view of the exemplary embodiment according to FIG. 1 being shown in FIG. 2. The antenna according to the invention in this case comprises a dual polarized radiator and a dual polarized radiator device 1.

In the exemplary embodiment shown, the dual polarized radiator device 1 comprises a dipole-like radiator 1', which radiates in two planes P1 and P2 perpendicular to one another (which are therefore aligned at an angle of 90° in relation to one another—FIG. 2), that is to say can transmit and receive. This may be, for example, a cruciform dipole radiator or a dipole square. In the exemplary embodiment shown, a so-called vector dipole known in principle from DE 198 60 121 A1 is shown.

The dual polarized radiator device 1 is arranged in front of a reflector 3. In the exemplary embodiment shown, the reflector 3 is a planar reflector. However, the reflector itself may also have a three-dimensional shape, for example be cylindrically bent about at least one axis or, for example, have a portion of a spherical curvature etc., or else be formed with some other kind of curvature.

In the exemplary embodiment shown, the reflector 3 extends substantially in two dimensions, whereby a longitudinal extent 5 and a transverse extent 7 are defined. When an antenna of this type is set up in a customary way, the longitudinal extent 5 would for example run in a vertical direction or substantially in a vertical direction, so that the transverse extent 7 points in a horizontal direction or substantially in a horizontal direction. As can also be seen from the graphic representation according to FIG. 2, the two polarization planes P1 and P2 that are perpendicular to one another are aligned in such a way that they run at an angle of ±45° with respect to the longitudinal direction 5 and/or the transverse direction 7 or are at least approximately aligned in such a way. With corresponding alignment of an antenna or an antenna array in a vertical or horizontal direction, a so-called X polarization is consequently obtained, in which the two polarization planes P1 and P2 are aligned at an angle of +45° with respect to the vertical or horizontal.

Provided substantially parallel to the longitudinal extent 5 are two longitudinal webs 9, which may be arranged on the outer limiting edge 3' on the reflector 3. However, the longitudinal webs 9 may also be arranged offset away from this edge 3' of the reflector 3, toward the radiator device 1, in front of the reflector. The longitudinal webs 9 are therefore arranged offset in relation to one another in the transverse direction and thereby receive the radiator device 1 between them.

The longitudinal webs 9 rise up above the plane of the reflector, that is to say are aligned with at least one component transversely or preferably perpendicularly in relation to the reflector 3, at least in relation to a reflector portion 3*a* in a region of the radiator device 1 or in the region of a possibly prescribed radiator foot (in the case of a dual polarized radiator device 1 for example at the foot of an associated balancing arrangement 1*a*).

In the exemplary embodiment shown, furthermore, two transverse webs 11 are also provided, running in the transverse direction 7, arranged offset in relation to one another in the longitudinal direction 5 and receiving the dual polarized radiator device 1 between them. The transverse webs 11 may be formed and arranged in a way comparable to the longitudinal webs 9, but this does not have to be the case. The transverse webs 11 may be arranged on the adjacent edge 3' of the reflector 3 or be offset away from it and arranged closer to the radiator device 1. These transverse webs 11 also rise up at least with one component, in the exemplary embodiment shown perpendicularly in relation to the plane of the reflector 3 or in relation to a corresponding reflector portion 3*a* in the region of the radiator device 1.

The described construction therefore defines an antenna environment, that is to say a radiator environment 101, which comprises for example longitudinal lines 105, running parallel to one another, and a pair of transverse lines 107, lying offset by 90° and running transversely in relation to said longitudinal lines, on which transverse lines the mentioned longitudinal and transverse struts or longitudinal and transverse webs 7, 9 are arranged, it also being possible but not obligatory for these longitudinal and transverse lines 105, 107 to coincide with the edge 3' of the reflector 3, but they may for example lie between the reflector edge 3' and the associated radiator 1, the longitudinal and transverse lines 105, 107 preferably running parallel to the edges 3' of the reflector 3. The distance between the longitudinal and transverse webs 9, 11, which are sometimes also referred to below as longitudinal and transverse profiles or longitudinal and transverse limitations or longitudinal and transverse side limitations, and the associated radiator device 1 in the antenna environment 101 is preferably more than 0.3λ and less than 1.2λ, where λ is a wavelength of the frequency band to be transmitted, preferably the mid-wavelength of a frequency band to be transmitted.

As mentioned, the dual polarized radiator device 1 radiates in two polarization planes P1 and P2 that are perpendicular to one another, which in the exemplary embodiment shown are arranged in an X-shaped manner, i.e. at an angle of +45° and an angle of −45°, respectively, with respect to the longitudinal or transverse webs 9, 11, that is to say they are not aligned parallel to the longitudinal and/or transverse webs.

In the representation according to FIG. 3*a*, a cross-sectional representation along the line III-III in FIG. 2 is reproduced. It illustrates the basic alignment of the longitudinal webs 9 with respect to the remaining reflector or reflector portion 3*a* in the region of the radiator 1 or in the region of the balancing arrangement 1*a* if it is a dual polarized dipole radiator, i.e. in the customary starting position preferably perpendicular to the plane of the reflector. Since, in the starting position, the two longitudinal webs 9 run parallel to one another (and are thereby aligned perpendicularly in relation to the reflector 3), the two longitudinal webs 9 come to lie in relation to one another with a longitudinal spacing LA.

According to the invention, however, it is now provided that the longitudinal side limitations 9 are pivotable, preferably individually or else, in a further embodiment of the invention, in a different way, are pivotable together.

In FIG. 3*b* it is shown in this respect that, for example, the left and right side limitations 9 can be adjusted in the same direction of adjustment, in the exemplary embodiment shown according to FIG. 3*b* in a counterclockwise-pivoted position. If it is assumed that a corresponding antenna is usually set up with the reflector plane in a vertical direction or approximately in a vertical direction, the cross-sectional representation shows that, with such an alignment of the longitudinal webs 9, the direction of the main lobe is no longer aligned perpendicular to the plane of the reflector 3 but is pivoted clockwise to the right in its azimuth direction, that is to say counter to the pivoting direction of the left and right side limitations 9. Only in special cases (extreme dimensioning, special combinations, specific resonant conditions etc.) can there possibly be pivoting of the direction of the main lobe in the other direction.

In the case of the exemplary embodiment according to FIG. 3*c*, an adjustment or pivoting of the longitudinal webs 5 takes place clockwise, whereby the main lobe is pivoted in the opposite direction.

In the case of the exemplary embodiment according to FIG. 3*d*, the two longitudinal webs are adjusted outward away from the associated radiator device, so that the longitudinal webs 9 are divergently aligned, viewed from the reflector. As a result, the clear distance LA between the longitudinal webs at the free end 9' of the longitudinal webs 9, opposite from the reflector 1, is increased in comparison with the basic position in FIG. 3*a*.

Figure 3E:
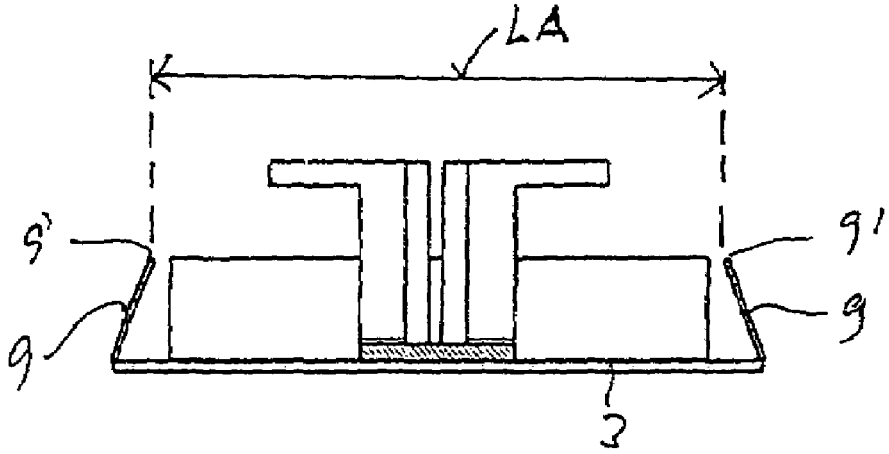

In the case of the exemplary embodiment according to FIG. 3*e*, the two longitudinal webs 9 are pivoted toward one another or aligned running toward one another (converging), whereby the clear distance LA between the upper edges 9' of the longitudinal webs 9 is reduced. In the two last-mentioned cases, a reduction or widening of the half-power beamwidth of the main lobe can be produced.

Figure 4A:
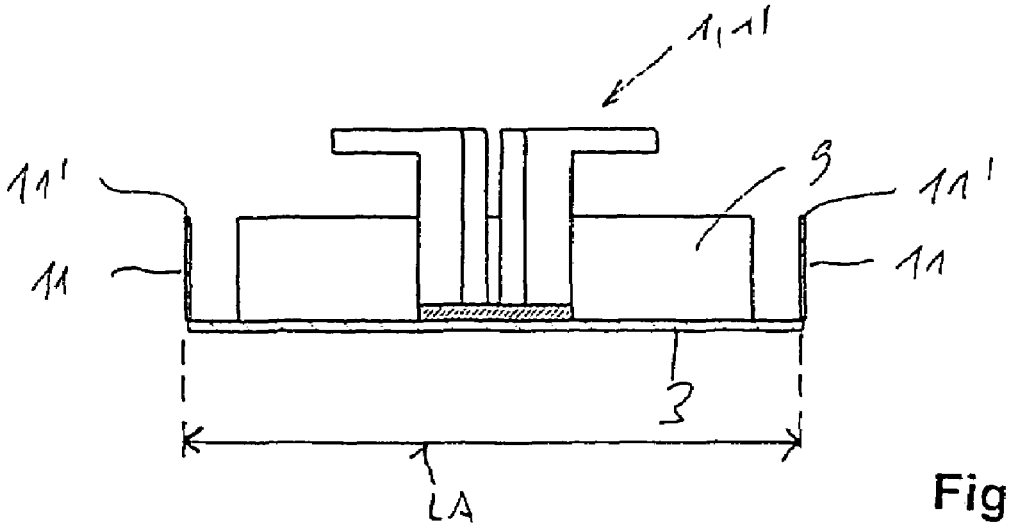
Figure 4B:
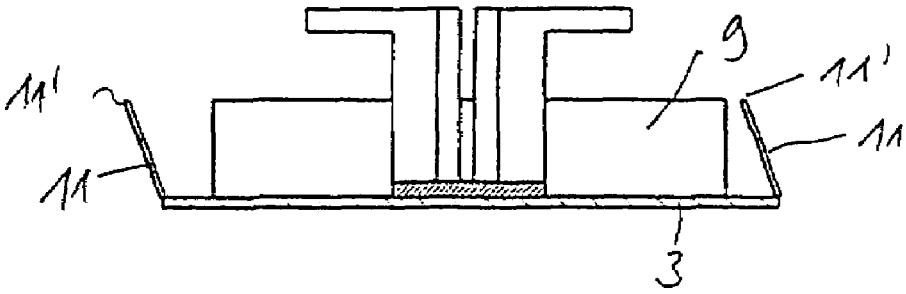
Figure 4C:
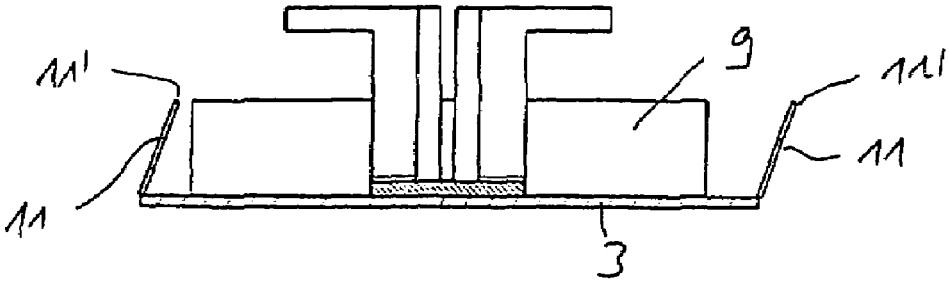
Figure 4D:
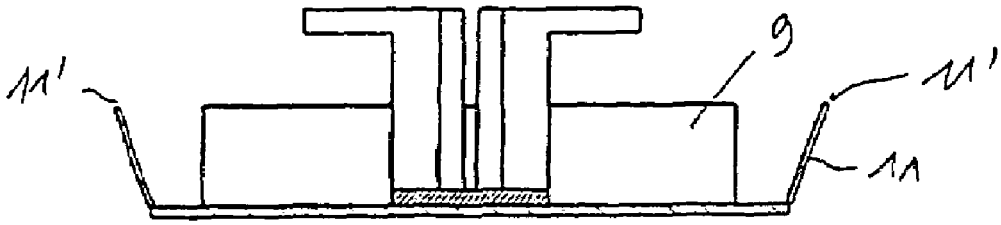
Figure 4E:
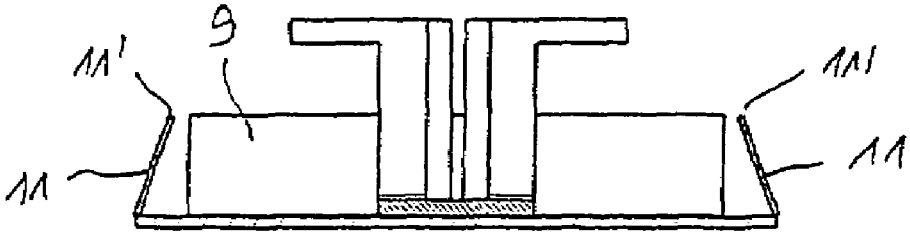

The transverse webs 11 may, for example, similarly or alternatively be adjusted individually or together, it being shown in FIG. 4*a* in a corresponding sectional representation along IV-IV in FIG. 2, in which the transverse webs 11 are aligned substantially perpendicularly in relation to the plane of the reflector or the reflector portion in the region 3*a* of the radiator device 1. In this case, the transverse webs may likewise again be pivoted together in one direction or in the other direction (FIGS. 4*b*, 4*c*). Furthermore, the transverse webs 11 may be set such that they are diverging or converging (running toward one another) from the reflector plane in the direction of the radiator (FIGS. 4*d*, 4*e*). Equally, however, it is also possible for only one transverse web to be aligned or pivoted correspondingly differently, whereas the other transverse web remains in its customary starting position according to FIG. 4*a*. Depending on the varied adjustment, the clear distance LA between the free ends 11' of the transverse webs 11 pivoted together or differently likewise changes again, so that the clear distance LA in FIGS. 4*a* to 4*c* remains the same and, in the case of the divergent representation according to FIG. 4*d*, becomes greater and, in the case of the convergent representation of the longitudinal webs 11 according to FIG. 4*e*, becomes smaller.

It is noted in principle that the antenna may also be provided either just with longitudinal webs 9 or just with transverse webs 11, depending on whether corresponding influencing and beam shaping is to be performed only in the transverse direction or only in the longitudinal direction. In extreme situations it is also possible, for example, for only a single longitudinal web and/or only a single transverse web to be provided, that is to say an asymmetric arrangement to the extent that a longitudinal or transverse web is only provided on one side and no web is provided on the opposite side. If appropriate, however, it is also possible for a positionally variable longitudinal web or transverse web to be provided only on a longitudinal side or on a transverse side, whereas the opposite longitudinal or transverse web, provided on the other side of the radiator device, is not adjustable.

It can be seen from the representations according to FIGS. 1 to 4*e* that the longitudinal webs 9 and transverse webs 11 end already before the corner points 15 (FIGS. 1 and 2), which are either corner points of the reflector 3, or, as points of intersection of the longitudinal and transverse axes or lines 105, 107, may be formed as pivoting or, for example, bending axes or lines 17 (FIGS. 1 and 2). This offers the advantage that, for example, both the longitudinal webs and the transverse webs can be pivoted toward a radiator device 1, at least in an adequate range of adjustment, preferably up to a maximum end position, in which they do not collide with one another or, at most, only touch at their corner points when in this end position.

In the case of the exemplary embodiment according to FIG. 5, only the transverse webs 11 for example are trapezoidally shaped, so that the longitudinal webs 9 can be pivoted unhindered toward a radiator device 1 as far as the path of the non-parallel sides 11' on the trapezoidal area. In the case of this embodiment, therefore, the other webs respectively, in this exemplary embodiment the longitudinal webs 9, may have a length which corresponds more or less to the spacing of the trapezoidal transverse webs 11, or is even longer. However, the exemplary embodiment may also conversely be such that the longitudinal webs are trapezoidally shaped and the transverse webs rectangular, and similarly all the longitudinal and transverse webs may be trapezoidally shaped or have some other, non-rectangular areal extent. In FIG. 5, as also however in the following FIG. 6, the respective radiator 1 is not included in the illustration for the sake of simplicity.

In the case of the exemplary embodiment according to FIG. 6, the length of the longitudinal webs 9 is at least slightly less than the clear distance LA between the transverse webs 11, in order to be able to pivot the longitudinal webs as desired, not only outward but also inward toward a radiator device. This is appropriate in particular whenever, for example, no transverse webs are provided, or the transverse webs are not to be changed at all in their alignment or are only to be pivoted outward.

Until now it has only been shown that the longitudinal and/or transverse webs can be brought into different alignment positions, for example by pivoting along the lines 105, 107. These longitudinal and transverse lines may therefore be formed as pivoting axes or pins 17. However, the mentioned longitudinal and transverse lines 105, 107 may also be designed as bending lines, in order to carry out the corresponding positional change or not only carry out a desired adjustment but also permanently retain it. This can be ensured by suitable mechanical or electrically activatable (remotely controllable) devices.

It is shown on the basis of the exemplary embodiment shown in FIG. 7 that the longitudinal webs 9 hang for example on pivoting pins 17, which are at least mechanically connected to the actual reflector 1. The pivoting pin 17 may also consist of a dielectric, that is to say a non-conducting material. Then, a separate, electrically conductive wire connection 19 could be provided, in order to connect the pivotable webs to the reflector 3 electrically/galvanically.

Shown in FIG. 7 is a detail of the reflector 3, which for example is provided only with longitudinal webs 9. Only a slightly outwardly flipped-open longitudinal web 9 is shown. The reflector 3 is connected electrically/galvanically and additionally mechanically, for example at its one longitudinal edge 3', to conductive sleeves 17*a*, through which an axial body 17' is inserted. This axial body 17' may consist of dielectric material. The pivotable longitudinal web 9 is likewise firmly connected, at least mechanically, to a number of sleeves 17*a* lying offset in the longitudinal direction, through which the axial body 17' is likewise inserted. As a result, a pivoting pin is formed, so that for example the longitudinal web 9 can be pivoted with the mechanically firmly connected sleeve 17*b* carrying it and the pin 17 formed in this way in relation to the reflector 3. The sleeves 17*a* and 17*b* mentioned, serving as a securing means, may consist for example of electrically conductive material, in particular metal. In this case, they are preferably connected electrically/galvanically to the reflector or the longitudinal web 9. If galvanic isolation is desired, an axial body 17' of dielectric material is used. An electrical/galvanic connection is preferably produced by a separate line 19, which may for example be soldered on at its end points, by means of which the side longitudinal web 9 is connected to the reflector 3 electrically/galvanically.

If an axial body 17 of electrical conductive material is used, the sleeves 17*a*, 17*b* serving as a pivoting device may also consist of electrically nonconductive material, if electrical isolation is to be provided.

A departure and modification is shown on the basis of FIG. 7*a* to the extent that here there is also provided on the reflector 3 a second longitudinal web 9*a*, which lies inwardly offset slightly in relation to the adjacent edge 3' and in the exemplary embodiment shown has a lower height than the pivotable and/or adjustable web 9, which in the exemplary embodiment shown lies on the outside. Such additional webs 9*a* that are partly only of small dimensions in their height (in particular fixed webs) allow the slot 18 formed between the pivotable web 9 and the reflector 3 to be virtually covered or concealed. Corresponding inwardly offset second transverse webs may similarly be provided in addition to the positionally changeable transverse webs 11, but this is not represented in any more detail in the drawings.

It is shown on the basis of FIG. 8 that, for example, the reflector 3 is firmly connected at its one longitudinal edge 3', over part of its length, to an electrically conductive cylinder 25, whereby an electrical/galvanic connection is established between the reflector 3 and the cylinder 25. This cylinder has inside in the axial core a cylindrical dielectric 27 (which can be seen in particular in the sectional representation according to FIG. 9). Inserted in the inner longitudinal clearance 29 is an electrically conductive inner conductor 31, by means of which for example the longitudinal web 9 is mechanically held and electrically/galvanically connected at its one end. The length of the inner conductor 31 is preferably $\lambda/4$, that is to say preferably with respect to the mid-frequency of a transmitted frequency band. As a result, therefore, a coaxial, capacitive coupling is realized between the the reflector 3 and the longitudinal web 9. On the opposite side, the fastening may take place correspondingly, so that each web is held by means of at least two such pivoting devices. The transverse webs may also be capacitively connected to the reflector 3 in this way. In the case of this exemplary embodiment, the pivoting pin 17 is then also formed at the same time by the inner conductor 31 of the capacitive connection.

It is also possible, however, for an electrically conductive pivoting connection to be provided.

In particular, the pivoting axis 17 may also be configured as a bending line, about which the longitudinal and/or transverse webs can be adjusted in their alignment or pivoted by a mechanism of their own.

Some further exemplary embodiments are shown below, to be precise on the basis of an antenna array with one column, within which a number of radiators 1 are arranged for example in the longitudinal direction (or for example in the transverse direction), to be specific in the exemplary embodiment shown four dual polarized radiators 1 in the form of a so-called vector dipole.

In the case of a cross-sectional representation according to FIG. 10 in a perspective representation and in FIG. 11 in a side representation, it is shown that the pivoting axis 17 may also be provided part-way up the longitudinal or transverse webs. In the case of a cross-sectional representation shown in FIG. 11, the pivoting or bending axis 17 may be provided at a distance from the plane of the reflector 3.

In the case of the exemplary embodiment according to FIGS. 12 and 13, the pivoting axis 17 is provided in the actual plane of the reflector 3. It can be seen from this how pivoting, for example of the longitudinal webs 9 (but similarly also of the transverse webs 11), can be accomplished by the outer portions 3" of the actual reflector 3 also being pivoted at the same time, since in this exemplary embodiment the longitudinal or transverse webs 9, 11 are preferably firmly connected to the outer portion 3" of the reflector itself.

In the case of the exemplary embodiment according to FIGS. 14 and 15, it is shown that, starting from the basic alignment according to the cross-sectional representation shown in FIG. 2, an adjustment is also possible by for example the longitudinal webs (and/or the transverse webs) being able to be bent, to be precise inwardly toward a radiator device (FIG. 14) or away from a radiator device (FIG. 15), so that the clear distance LA between two webs bent toward one another for example become smaller (compared with the parallel basic alignment) or greater if the bending takes place outwardly. Equally, however, joint bending to the left or right may take place, in which ultimately the clear distance LA at the outlet edge of the relevant webs remains unchanged with respect to the basic alignment or at least approximately or substantially unchanged, or at least the change in length LA is comparatively small.

As a departure from the exemplary embodiment shown, the longitudinal or transverse webs may, however, not only consist of electrically conductive material, usually a metal or metal sheet, but for example also of electrically conductive, coated material or electrically conductive plastic material. The use of dielectric material is also possible, in particular material with a particularly high dielectric constant, whereby beam shaping in the sense described is also possible.

A further exemplary embodiment of an antenna according to the invention is then shown in a perspective view by FIG. 16 and in a longitudinal sectional representation in FIG. 17. With customary vertical alignment of the reflector 3, this produces a column arrangement with four radiator devices 1 arranged one above the other.

In the exemplary embodiment shown, the longitudinal webs 9 which can be pivoted about their pivoting axis or can be bent about their pivoting axis, or else can only be made to curve as a whole by introducing adjusting forces into them (comparable to the exemplary embodiment shown in FIG. 14 or 15), are formed contiguously as one-part longitudinal webs 9, with respect to their respectively associated radiator device 1. The transverse webs 11 shown may be provided in this embodiment and, for example, not adjustable. However, it is also possible here that in this exemplary embodiment the transverse webs can be jointly pivoted upward or downward, or at least individual transverse webs can be pivoted upward or downward, in order to accomplish in particular further electrical properties here with respect to the adjustment of the main lobe in the downtilt direction.

If, for example, the transverse webs 11 are not adjustable, but the continuous longitudinal webs 9 are, to be precise not only outwardly but also inwardly toward the radiator device 1, it may be recommendable to provide apertures in the longitudinal webs, for example so-called slot-shaped apertures or clearances 12, as can be seen from the enlarged representation of a detail according to FIG. 17*a*. The left-hand longitudinal web is in this case pivoted outward. The right-hand longitudinal web 9 is pivoted inward, so that in this case space is created by the slots running transversely in relation to the bending or pivoting axis 17, through which the end regions of the transverse webs can then protrude. This example shows that, even in this case, the transverse webs can reach as far as the outer limiting edge 3' of the reflector.

In the case of the exemplary embodiment according to FIG. 18, an antenna array with two columns is shown in a schematic front view and in FIG. 18*a* in a schematic perspective representation, four radiator devices likewise being provided in each column. In this exemplary embodiment, two outer, separately adjustable longitudinal webs and two associated transverse webs are provided for each radiator device and each associated radiator array. Consequently, two transverse webs and two longitudinal webs come to lie respectively between two horizontally or vertically, that is to say between two radiator devices arranged offset in relation to one another in the longitudinal direction or the transverse direction, which webs can be adjusted with respect to the associated radiator device independently of the neighboring radiator device, in order to bring about the desired beam shaping. With two radiators 1, 1' respectively arranged next to one another in the longitudinal direction 5 or in the transverse direction 7, i.e. radiator environments or radiator surroundings 101 lying offset in relation to one another in the longitudinal or transverse direction, consequently two longitudinal or transverse webs 9, 11 belonging to different radiators respectively come to lie in relation to one another, to be precise respectively with a yielding distance A, which offers sufficient space also to adjust these longitudinal or transverse webs outwardly, that is to say away from the respective radiator device 1.

In the case of the exemplary embodiment according to FIG. 19 it is shown in plan view and in FIG. 20 in a schematic, perspective representation that, for example, the longitudinal webs (but this also equally applies to the transverse webs) can be arranged with varied lateral spacing from associated radiator devices 1 (or their foot point or balancing arrangement 4), so that the reflector 3 has a varied width in the transverse direction 7, at least for some of the radiator devices 1. At the end of the respective longitudinal webs 9, the latter may be connected to one another by means of a short cross-connecting piece 11*a*. The longitudinal webs may, however, also end openly, without such a connecting piece. The cross-connecting pieces are to be formed in relation to a length of the longitudinal extent in such a way that the longitudinal webs 9 can preferably be adjusted inwardly and outwardly at their bending lines.

Furthermore, FIGS. 19 and 20 show that, for example, two transverse webs 11 are provided only for the uppermost radiator device, if appropriate fixedly arranged (that is to say unadjustable) or likewise again able to be aligned jointly or independently of one another so as to run toward the associated radiator device or run away from it in the direction of radiation.

In the case of all the exemplary embodiments described, the beam shaping always takes place in the near field, that is to say in a range less than λ or at least 2λ, 1.5λ or less than 1.2λ, where λ is once again the wavelength from a frequency band to be transmitted, preferably the mid-wavelength.

The pivotable parts explained (longitudinal and/or transverse webs) are preferably—as explained—galvanically connected to the reflector 3, to be precise by means of a bendable, conducting structure, for example spring elements, a thin conductive layer on a film substrate or by bendable regions for example of at least partly flexible printed circuit board. The pivotable parts may, however, equally be capacitively coupled to the reflector 3, for example over a small distance. The capacitive coupling may in this case likewise again be differently constructed, for example by means of a coaxial, capacitive coupling.

It is evident from the exemplary embodiment described that one or more dual polarized radiators may be provided, formed by an identical type of construction or different type of construction, it being possible for at least always one and preferably at least always two pairs of interacting longitudinal webs or longitudinal profiles or transverse webs or transverse profiles to be pivoted toward one another or against one another or parallel to one another, one after the other, individually or synchronously, to be arranged in an electrically connected or non-electrically conducting manner with respect to the reflector, partly electrically connected and partly not electrically connected. The side and longitudinal webs or profiles may be arranged separately from one another or at least partly connected to one another, at least mechanically or else electrically/galvanically connected to one another. The individual parts can be dimensioned differently in the longitudinal direction, the transverse direction and in height and also the shaping of the longitudinal and/or transverse webs or profiles can be chosen differently, in order to achieve the desired advantageous effects.

As an additional comment on the preceding exemplary embodiments, it is noted that, for example, the pivotable side walls 9 may be higher or lower than the dividing or transverse walls 11 running transversely to them, as can also be seen from the representation according to FIG. 20. The dividing walls may also be fixed, that is say immovable. If the transverse webs 11 are comparatively long, clearances corresponding to the longitudinal webs 9 may be provided, in order to allow them to be pivoted about their bending axis, as already disclosed in principle by the exemplary embodiment according to FIG. 6.

Finally, it is pointed out that the radiators described in the various examples, in particular when a number of radiators are provided in the case of an antenna, they can be individually activated and operated. Equally, however, it is also possible for a number of radiators to be electrically combined in a group. To this extent, there are no restrictions or limitations.

Reference is made below to a modified exemplary embodiment according to FIG. 21, in which it is shown in cross section, in a way comparable to FIGS. 3*a* to 3*e* (but also equally applies to the cross-sectional representation according to FIGS. 4*a* to 4*e*) that, for example, the longitudinal walls or longitudinal webs 9 may also be divided in two, to be specific comprise a first portion 9.1 and a second portion 9.2, which are pivotable in relation to one another by means of a common bending line or pivoting or tilting axis 17'. The longitudinal-web or longitudinal-wall portion 9.2 lying closer to the reflector 3 is then pivotable relatively with respect to the reflector by means of the bending line 17 already explained a number of times, or the corresponding pivoting or tilting axis. Similarly as explained in respect to other exemplary embodiments, this part 9.2, lying closer to the reflector, may be bendable or, for example in a way corresponding to the exemplary embodiment shown in FIGS. 12 and 13, pivotable, tiltable or bendable with a side portion of the actual reflector.

For example, the longitudinal-web portions 9.1 lying further away from the reflector 3 may, if appropriate, be pivotable about their bending or tilting axis 17' even to such an extent (altogether by almost 360°) that this longitudinal-web portion 9.1 bears either on the inside or on the outside against the further longitudinal-web portion 9.2 lying closer to the reflector 3, in order that the upper portion of the longitudinal web 9 is fully flipped in, and consequently ineffective.

As explained several times, the lower and also the upper longitudinal-side portion 9.1 and 9.2 may in this case also be aligned parallel to one another, pivoted to the left or right, set running toward one another or diverging or else differently. Finally, the portion 9.2 lying closer to the reflector may also be pivoted outward in such a way that it lies in a line extending the plane of the reflector 3. As a result, the width (or length) of the reflector would in effect be changed, the longitudinal-side portion 9.2 on the outside then remaining as the only web, aligned for example perpendicularly or generally at an angle with respect to the reflector. However, this further portion can also be pivoted outward or inward into the plane of the reflector, in order as a result to change the reflector width (or length).

If the portion 9.2 were flipped over inwardly onto the reflector plane, this would produce as a result a longitudinal-side portion 9.1 which could be pivoted as far as desired perpendicularly in relation to the reflector plane or to the left or right.

The conditions described may equally also be applied to the transverse webs. Finally, the longitudinal and/or transverse webs may also be divided not only in two but also multiply, whereby if appropriate a number of bending, pivoting or tilting axes are obtained, preferably running parallel to one another.

It is noted entirely as a point of principle that, on laterally next to an antenna environment 101, not only a continuous transverse or longitudinal wall, that is to say a continuous transverse or longitudinal web, has to be provided in each case, but that here there may also be provided at least two or in each case a number of longitudinal-web portions and/or transverse-web portions, which could be adjusted individually in their alignment position.

A further slight modification is reproduced in FIG. 22 in a schematic cross section and in FIG. 22*a* in a schematic perspective representation. In this exemplary embodiment, the pivotable webs, for example longitudinal webs, are arranged lying offset inward from the outer edge 3' of the reflector, so that the corresponding pivoting axes or bending lines 17 lie closer to the actual radiator 1, 1'. Provided on the outside are fixed longitudinal or transverse webs 309.

The heights of the outer webs 309 and of the inner longitudinal webs 9 may be chosen to be equal or different. Corresponding conditions may also be provided additionally or alternatively for the transverse webs.

In the case of the exemplary embodiment according to FIG. 23, a corresponding arrangement of an antenna or of an antenna array is shown in a schematic cross-sectional representation, for example comparable to the cross-sectional representation in FIG. 3*a*, in which arrangement two longitudinal webs (or two transverse webs) are likewise again provided on one side of the radiator with a lateral spacing from one another. In this exemplary embodiment, the web 9 lying closer to the radiator, but also the outer web 309 lying further away, are respectively pivotable about a pivoting axis 17, preferably to an unlimited extent. Both longitudinal webs (or transverse webs), arranged parallel with lateral offset in relation to one another, may have any desired height. The lateral spacing between the respectively parallel longitudinal or transverse webs is preferably at least equal to or smaller than their respective height, so that—as shown on the basis of FIG. 23—the outer longitudinal web (or in the case of FIG. 24 the inner longitudinal web) can be flipped over fully inward or outward on the reflector. Equally, however, the outer longitudinal web 309 can also be flipped over fully outward, for example lie in the plane of the reflector 3, whereby the reflector width (or length) can be increased.

In addition, however, the inner longitudinal web 9 could also be fully flipped over, so that virtually both longitudinal webs (or transverse webs) would no longer be effective.

On the basis of FIG. 24 it is only shown that it is also possible, conversely, for the inner longitudinal web itself alone to be flipped over, whereas the outer longitudinal web can be brought into any desired position running perpendicularly or at an angle to the reflector plane.

Finally, it is also additionally shown on the basis of FIG. 25 that the webs respectively provided in pairs lying opposite in relation to the radiator device 1 and preferably running parallel to one another (the inner and outer webs), for example the inner longitudinal web 9 and the outer longitudinal web 309, may also be pivoted as desired in relation to one another, that is to say for example running toward one another (as shown in FIG. 25) or running away from one another, or both to the left or to the right, etc. To this extent, reference is made to the basic adjusting possibilities of the other exemplary embodiments.

It is mentioned only for the sake of completeness that, in particular, the use of double webs corresponding to the representations shown in FIGS. 22 et seq may be of advantage whenever, for example, slots are also provided at the webs lying further outward.

Finally, it is merely mentioned that the radiator devices 1, 1' may be operated as in the case of known types of antenna. The corresponding reflector configurations may be realized both in the case of a single band antenna, a dual band antenna but also in the case of a multiband antenna. In particular if a number of radiators are used, they may be electrically combined in a group.

The invention claimed is:

1. A dual polarized antenna comprising:

a reflector having a plane, at least one dual polarized radiator device disposed on said reflector, the at least one dual polarized radiator device having polarization planes, the polarization planes of the at least one radiator device being aligned at an angle of +45° and −45° respectively, with respect to the longitudinal or transverse direction of the reflector, a first web pivotably disposed on the reflector, said first web having a first longitudinal edge, a second web pivotably disposed on said reflector, said second web having a second longitudinal edge, said first and second webs being arranged on said reflector so that said first and second longitudinal edges are disposed parallel to and offset in relation to one another, the at least one dual polarized radiator device being disposed between the first and second webs, and a third web disposed on said reflector, said third web having a third longitudinal edge parallel to and offset in relation to said second longitudinal edge, wherein:

the first and second webs are positionally changeable by pivoting with respect to the reflector, and the reflector is electrically/galvanically separated from and/or capacitively connected with at least one of the first and second webs.

2. Antenna according to claim 1, wherein the first and second pivotable webs comprise at least one pair of longitudinal and/or transverse webs that are pivoted in the same direction.

3. Antenna according to claim 1, wherein said first and second webs comprise at least one pair of longitudinal and/or transverse webs that are pivoted toward one another.

4. Antenna according to claim 1, wherein at least one of said first and second webs comprises at least one pair of longitudinal and/or transverse webs that are pivoted away from one another.

5. Antenna according to claim 1, wherein pivoting axis runs parallel to the webs.

6. Antenna according to claim 1, wherein said first and second webs comprise plural longitudinal webs and/or transverse webs interacting with respect to a radiator device that are pivotable toward one another in such a way that the clear distance between the ends of the longitudinal and/or transverse webs lying away from the reflector is greater than in a basic position, in which the longitudinal and/or transverse webs are aligned perpendicular to the plane of the reflector or to a reflector region in the direct vicinity of the radiator device.

7. Antenna according to claim 1, wherein said first and second webs comprise plural longitudinal webs and/or transverse webs interacting with respect to a radiator device that are pivoted away from another in such a way that the clear distance between the ends of the longitudinal and/or transverse webs lying away from the reflector is less than in a basic position, in which the longitudinal and/or transverse webs are aligned perpendicular to the plane of the reflector or to a reflector region in the direct vicinity of the radiator device.

8. Antenna according to claim 1, wherein the first and second webs have a pivoting axis that is arranged part-way up and at a distance from the plane of the reflector, parallel to the plane of the reflector or a reflector region in the vicinity of the radiator device.

9. Antenna according to claim 1, wherein the first and second webs have a pivoting axis that lies offset in relation to the longitudinal and/or transverse webs, in the plane of the reflector.

10. Antenna according to claim 1, wherein the reflector has a reflector portion that can be pivoted with an associated longitudinal and/or transverse web about a pivoting axis.

11. Antenna according to claim 1, wherein the first and second webs comprise longitudinal webs and transverse webs provided on either side of the radiator device to form a radiator environment, an associated reflector projecting beyond the longitudinal webs and/or transverse webs, viewed from the associated radiator device.

12. Antenna according to claim 1, wherein at least one of the first and second webs is mechanically connected to the reflector by means of a dielectric pivoting body, forming a pivoting axis or pin.

13. Antenna according to claim 1, wherein the first and second webs, have or comprise, thin conductive layer spring elements on a film substrate or partly flexible printed circuit boards or portions of a printed circuit board.

14. Antenna according to claim 13, wherein the positional change of first and second webs is remotely controllable.

15. Antenna according to claim 1, further including means for adjusting manually or by means of an actuating or control device.

16. Antenna according to claim 1, wherein at least one of the first and second webs has varied heights over its entire length of extent or at least has a different height than a further web.

17. Antenna according to claim 1, wherein the first web can be flipped over onto the plane of the reflector, the bending and/or pivoting axis arranged at the outer limitation of the reflector being able to increase the area of the reflector when the first web is pivoted outward.

18. Antenna according to claim 1 wherein said third web is also pivotable with respect to said reflector.

19. Antenna according to claim 1 wherein said reflector defines an edge, said third web is disposed at said reflector edge, and said second web is disposed between said third web and said radiator device.

20. Antenna according to claim 1, wherein said reflector defines an edge, said second web is disposed at said reflector edge, and said third web is disposed between said second web and said radiator device.

21. Antenna according to claim 1, wherein no radiator device is disposed between said second and third webs.

* * * * *